US012709866B2

(12) United States Patent
Heinzler

(10) Patent No.: US 12,709,866 B2
(45) Date of Patent: Aug. 18, 2026

(54) WORK MACHINE

(71) Applicant: Jonas Heinzler, Sauldorf (DE)

(72) Inventor: Jonas Heinzler, Sauldorf (DE)

( * ) Notice: Subject to any disclaimer, the term of this patent is extended or adjusted under 35 U.S.C. 154(b) by 382 days.

(21) Appl. No.: 18/028,060

(22) PCT Filed: Sep. 24, 2021

(86) PCT No.: PCT/EP2021/076382

§ 371 (c)(1),
(2) Date: Mar. 23, 2023

(87) PCT Pub. No.: WO2022/064000

PCT Pub. Date: Mar. 31, 2022

(65) Prior Publication Data

US 2023/0340756 A1 Oct. 26, 2023

(30) Foreign Application Priority Data

Sep. 25, 2020 (DE) ..... 10 2020 125 036.3
Sep. 25, 2020 (DE) ..... 10 2020 125 042.8
Sep. 25, 2020 (DE) ..... 10 2020 125 047.9

(51) Int. Cl.
*E02F 9/18* (2006.01)
*E02F 3/30* (2006.01)
(Continued)

(52) U.S. Cl.
CPC ..... *E02F 9/18* (2013.01); *E02F 3/302* (2013.01); *E02F 3/3405* (2013.01); *E02F 9/2004* (2013.01)

(58) Field of Classification Search
CPC . E02F 3/302; E02F 3/3405; E02F 9/18; E02F 9/2004
See application file for complete search history.

(56) References Cited

U.S. PATENT DOCUMENTS 2,766,850 A 10/1956 Marnon et al.
3,856,149 A * 12/1974 Shaw ..... B60P 3/28 280/638
(Continued)

FOREIGN PATENT DOCUMENTS

CN 101808849 A 8/2010
CN 104480985 A 4/2015
(Continued)

OTHER PUBLICATIONS

International Preliminary Report on Patentability and Written Opinion dated Mar. 28, 2023 for corresponding application PCT/EP2021/076382.
(Continued)

*Primary Examiner* — Saul Rodriguez
*Assistant Examiner* — Brendan P Tighe
(74) *Attorney, Agent, or Firm* — Bachman & LaPointe, P.C.

(57) ABSTRACT

A work machine (1.1, 1.2, 1.3) having precisely one main vehicle axle (3), wheel elements (4.1, 4.2) arranged on the main vehicle axle (3) on both sides, and a working unit (2) or a holder (9) for a working unit. The working unit (2) is arranged on a vehicle frame (12) by means of at least one pivot arm (6, 6.1, 6.2) with at least one rotatably mounted working arm (7, 7.1, 7.2). The work machine (1.1, 1.2, 1.3) also includes at least one displaceable weight (5, 5.1, 5.2), which is arranged on the vehicle frame (12) by means of at least one rod system (11, 11.1, 11.2), wherein an exclusive movement channel (16.1, 16.2, 16.3, 16.4, 16.5, 16.6, 16.7, 16.8, 16.9, 16.10) along the vehicle longitudinal axis (14) is assigned to each of the displaceable weight(s) (5, 5.1, 5.2), the rod system(s) (11, 11.1, 11.2) and the pivot arms (6, 6.1, 6.2) with the working arms (7, 7.1, 7.2).

17 Claims, 16 Drawing Sheets

(51) Int. Cl.
*E02F 3/34* (2006.01)
*E02F 9/20* (2006.01)

(56) References Cited

U.S. PATENT DOCUMENTS

| | | | | | |
|---|---|---|---|---|---|
| 6,065,556 | A * | 5/2000 | Andrews | E02F 9/0808 | 180/209 |
| 2009/0038186 | A1 * | 2/2009 | Osswald | B62D 49/085 | 37/468 |
| 2009/0206589 | A1 * | 8/2009 | Osswald | B62D 21/14 | 187/234 |
| 2019/0382982 | A1 * | 12/2019 | Santo | E02F 9/2037 | |

FOREIGN PATENT DOCUMENTS

| | | | | |
|---|---|---|---|---|
| DE | 102005040954 | A1 | 12/2006 | |
| DE | 102017100963 | A1 * | 7/2018 | B62D 49/085 |
| DE | 102017100963 | B4 | 3/2020 | |
| DE | 102018217570 | A1 | 4/2020 | |
| FR | 622919 | A | 6/1927 | |
| WO | 2009020509 | A1 | 2/2009 | |
| WO | WO-2022064000 | A1 * | 3/2022 | B66C 23/76 |

OTHER PUBLICATIONS

Office Action Dated Jun. 11, 2021 for corresponding application DE 10 2020 125 042.8.
International Search Report dated Jan. 25, 2022 for corresponding application PCT/EP2021/076382.

* cited by examiner

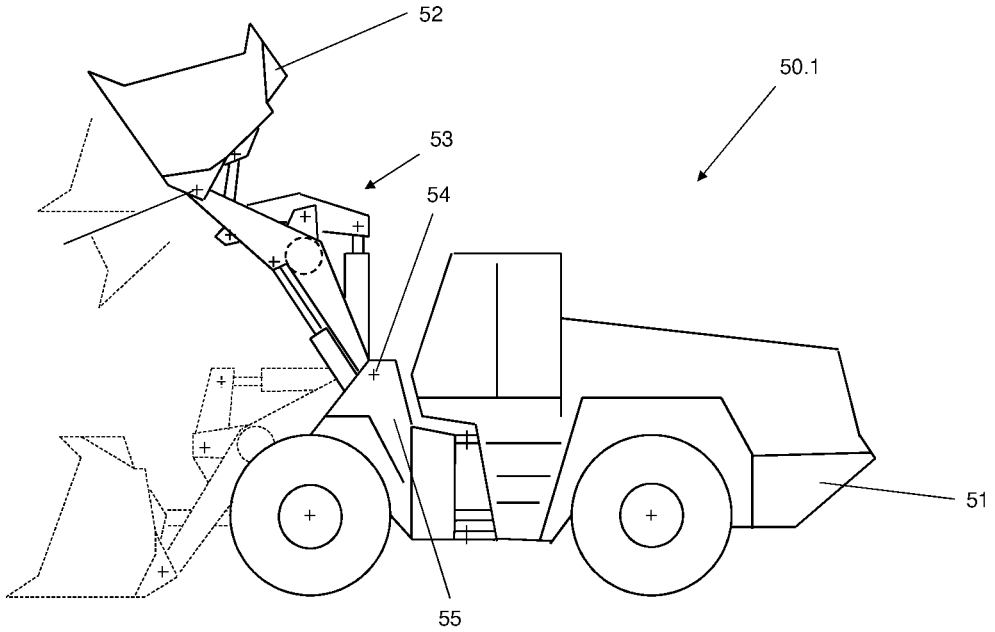
Fig. 1 - state of the art
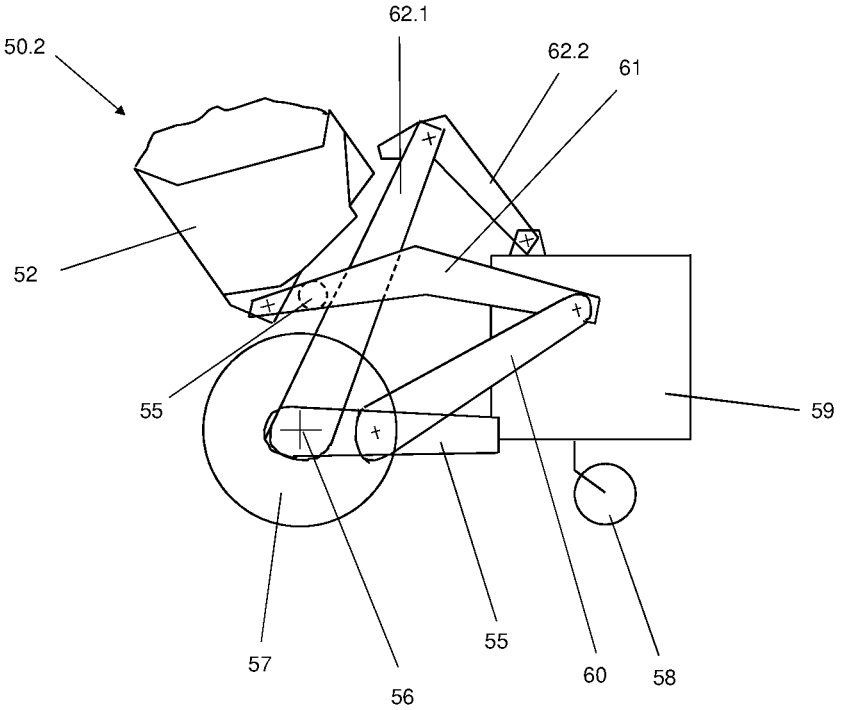
Fig. 2 - state of the art

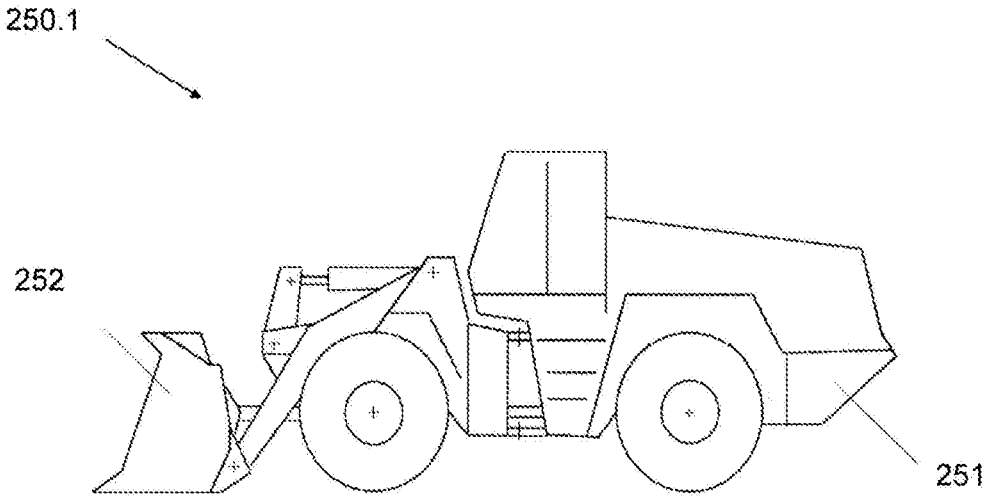
Fig. 8 - state of the art
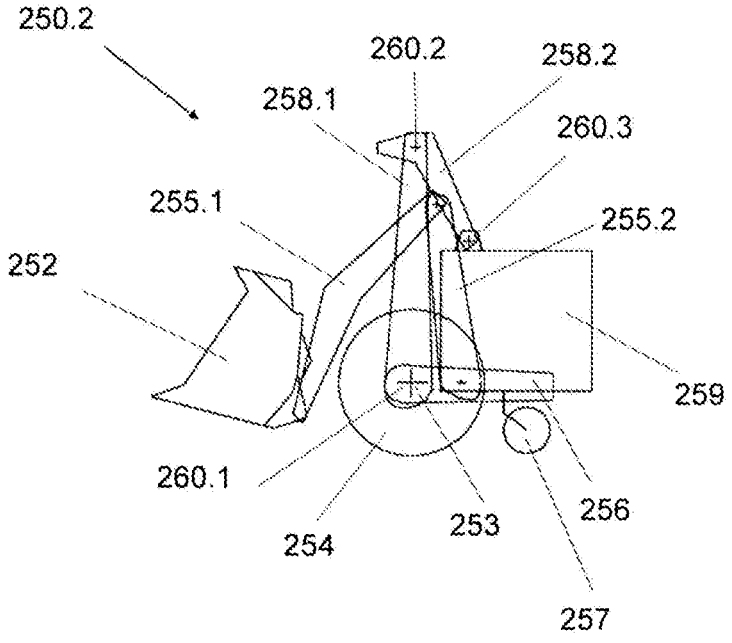
Fig. 9 state of the art

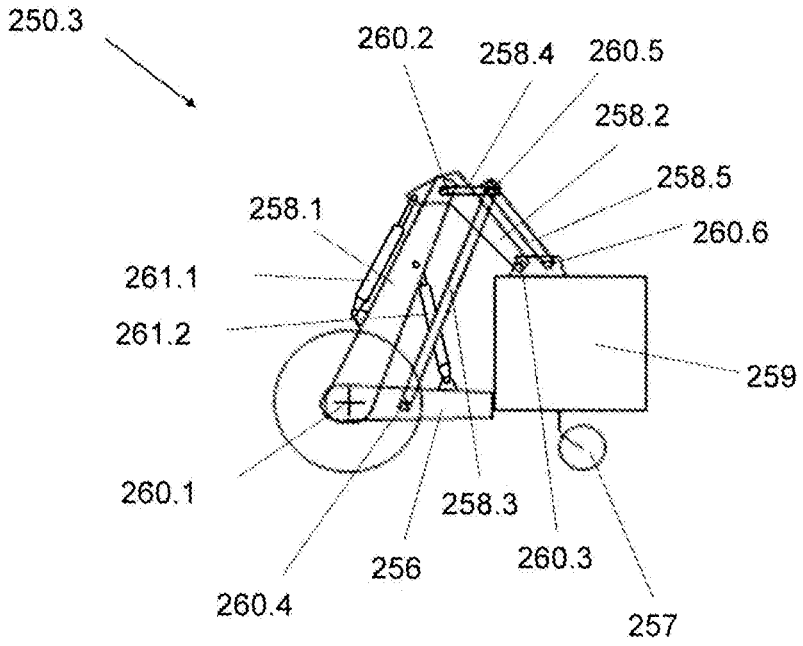
Fig. 10 - state of the art
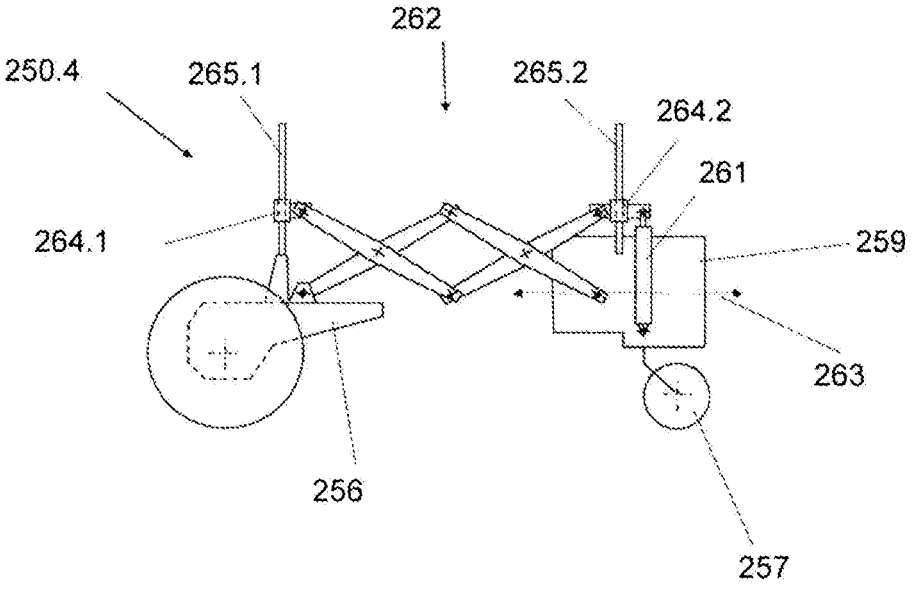
Fig. 11 state of the art

WORK MACHINE

BACKGROUND OF THE INVENTION

The invention relates to a work machine.

Various work machines, such as wheel loaders, backhoe loaders or skid steer loaders, are known from the prior art, in which a working unit is attached to the front end of the vehicle. This working unit can be a shovel, a stacking fork or other working units commonly used in the agricultural and construction industries. The working unit, for example the bucket, can be raised or lowered. For this purpose, the wheel loader (see FIGS. 1*a* and 1*b*) uses a lifting frame that is rotatably attached to the front end of the wheel loader with hinges on one side. The hinges used only allow a rotary motion in a vehicle longitudinal axis, which means that the lifting frame can only be rotated upwards or downwards. The working unit, which in the case of a wheel loader is very often a bucket, moves on a circular path, the center of which is represented by the hinges with which the lifting frame is attached to the vehicle frame. On the rear side there is a fixed counterweight. The stability of this wheel loader against tipping over to the front around the front axle is mainly influenced by the weight in the bucket, its distance to the front axle and the weight of the counterweight and its distance to the front axle. Here, the rotation of the lifting frame on the circular path has a disadvantageous effect, since the distance in the horizontal direction only increases when the bucket is lifted off the ground. The disadvantage of this wheel loader is the fixed, non-displaceable position of the counterweight and the distance of the bucket from the front axle, which cannot be changed in the horizontal direction, outside the fixed circular path.

SUMMARY OF THE INVENTION

It is the object of the present invention to overcome the disadvantages of the prior art. In particular, it is the object of the invention to provide a work machine, or a vehicle, which is suitable for the common work tasks of today's work machines and at the same time has a high degree of maneuverability and flexibility. Furthermore, it is the object of the invention to provide a work machine, respectively a vehicle, which has a lower weight with a constant performance as well as a higher agility and a lower parts density. Furthermore, it is the object of the invention to provide a work machine or a vehicle, which can be used flexibly as a basic carrier vehicle for various working units. In addition, it is the object of the invention to provide a work machine or a vehicle with which an increase in productivity is made possible and which also meets modern ecological requirements.

The features disclosed herein lead to the solution of the object. Advantageous embodiments are also described herein and in the dependent claims.

For this purpose, vehicles with a displaceable weight and a displaceable working unit are to be used. Both are to be displaceable in a sufficiently wide range, thus enabling a very compact vehicle and keeping the vehicle's center of gravity in an ideal range. The displacement of the displaceable weight shall be done by a rod system, which guides the displaceable weight very close to the area of the main vehicle axle, or above it. Also, the displacement of the working unit is to be done by a pivot arm and a working arm that guides the working unit very close to the area of the main vehicle axle. For this purpose, a vehicle structure is to be found in which the position and movement space of the pivot arm, the working arm for receiving and moving the working unit, and the position and movement space of the displaceable weight are made possible.

A work machine according to the invention comprises precisely one main vehicle axle, wheel elements arranged on both sides of the main vehicle axle, a working unit or a holder for a working unit, whereby this is arranged on a vehicle frame by means of at least one pivot arm with at least one rotatably mounted working arm. Furthermore, the work machine according to the invention comprises at least one displaceable weight, wherein this is arranged on the vehicle frame by at least one rod system. In this case, the displaceable weight, the rod systems and the pivot arms with the working arms are each assigned exclusively one movement channel along the longitudinal direction of the vehicle.

A work machine according to the invention thus has, in contrast to a prior art work machine, a structure which enables it to move both the working unit with its large mass and the heavy displaceable weight into the central region of the work machine, which is located in the vicinity of the main vehicle axle. Thus, the center of gravity of the vehicle can always be kept in this range, thus achieving a stable position for the vehicle. In addition, the work machine according to the invention can thus takes up a very compact position, in contrast to a machine of the prior art. This results in the advantage that a work machine according to the invention can be used in narrow locations, such as often occur on inner-city construction sites, where it can be operated in a very agile manner. In addition, this results in the advantage that a significantly lighter work machine can be provided that can nevertheless lift and transport the same usable load as the comparable prior art work machine. This is made possible by the fact that, in the case of the work machine according to the invention, the load is located very close to the main vehicle axle when it is lifted, similar to the situation with prior art counterbalanced forklifts. Once this has been raised to the point where the working unit and/or the load is above the wheel elements, it can be moved even further towards the main vehicle axle. This is made possible by the fact that the working arms and pivot arms can move freely and independently of the movements of the displaceable weight in the movement channels assigned to them. For lifting the load from the ground, the displaceable weight is extended far to the rear. Thus, due to the leverage effect of its position, this can be light and still allow high loads on the working unit without the vehicle losing its stable position. The comparably low displaceable weight has a beneficial effect on the overall weight of the vehicle. As soon as the working unit with the picked-up load is retracted further over the main vehicle axle, the displaceable weight is retracted further in return. This is made possible by the fact that both the displaceable weight and the rod systems arranged thereon are each assigned to their own movement channels, as a result of which the movements of the working unit and the movements of the displaceable weight essentially do not interfere with each other.

Thus, in contrast to a work machine of the prior art, the work machine according to the invention has a significantly better ratio of payload to dead weight. Particularly in the case of smaller work machines, a further advantage is that the work machine according to the invention can be transported on simple vehicle trailers without exceeding their maximum permissible total weight. A further advantage of the machine according to the invention is that, due to its lower weight, it can be used inside buildings on higher floors without exceeding their maximum permissible floor load. Furthermore, it can be moved to different floors by means of the elevators available in the buildings without exceeding the permissible payload of the elevators.

In a preferred embodiment, the displaceable weight and its assigned movement channel take up a central position on the vehicle's transverse axis. This results in the advantage that a significant proportion of the vehicle width can be allocated to the displaceable weight and the assigned movement channel. Since the displaceable weight also represents a container that can contain various functional elements, such as energy converters, oil tanks and/or hydraulic pump, this ideally takes up the central position in the transverse direction. Thus, only one such container is required and thus only one centrally located movement channel. Further out to the side, one rod system per side is arranged for displacement of the displaceable weight, whereby in a particularly preferred embodiment at least two are required for this purpose. Thus, the working arms and the pivot arms are arranged laterally on the very outside. In the preferred embodiment, the movement channel for the displaceable weight is arranged in such a way that its lower limit lies above the main vehicle axis and its upper limit lies below the transverse rods required for the lateral stability of the rod systems. This has the advantage that the rod systems can be made very narrow, since their lateral stability is ensured by the use of one or more transverse rods. This has the advantage that the movement channels for the rod systems can be made very narrow and that the vehicle width can therefore be comparably narrow.

In a typical embodiment, the pivot arms and the working arms arranged thereon each lie in one level. This results in the advantage that the forces exerted by the load of the working unit, as well as those exerted by the adjusting elements, for example hydraulic cylinders, do not generate excessively high bending moments. In addition, this results in the advantage that the movement channels required for the free movements can be made narrow. As a result, the work machines according to the invention can have an overall narrow design.

In a further embodiment, pivot arms and working arms are arranged laterally, i.e. in the direction of the transverse axis of the vehicle, on the outside in each case, adjacent to the movement channels of the rod systems. This has the advantage that the pivot arms and working arms can absorb the forces acting unevenly on the working unit.

In another typical embodiment, the wheel elements are arranged in the same level as the pivot arms and the working arms. This results in the advantage that the work machine according to the invention can be built very narrowly. This makes it very compact not only in its vehicle length but also in its width. When used inside buildings, such work machines have the advantage that they can pass through door openings with common opening widths, for example.

In a further embodiment, a work machine according to the invention comprises only a pivot arm and a working arm arranged thereon. These take up a central position, whereby a movement channel for the pivot arm and the working arm is also assigned to a central position on the transverse axis of the vehicle. The advantage of this embodiment is that fewer drive elements are required to move the pivot arm and the working arm compared to machines with several pivot arms and working arms. If electric actuators are used, the often used hydraulic system consisting of oil tank, hydraulic pump, filter, valves and hoses can be omitted. The electric actuators, as often used in the prior art for driving robot arms, can be supplied with power directly from an electric storage unit via electric cables. This means that the number of components required can be smaller. However, the electric actuators themselves are more complex and expensive than hydraulic cylinders. Therefore, a design of the work machine according to the invention is advantageous when electric actuators are used if the number of drives or actuators required is small.

On both sides of the movement channel for the pivot arm and the working arm and adjacent thereto are arranged two movement channels which allow the movements of at least two rod systems for fastening and displacing displaceable weights. Laterally adjacent to the movement channels of the rod systems, i.e. in the direction of the transverse axis of the vehicle on the very outside in each case, at least one movement channel is arranged on each side, which enables the movements of at least one displaceable weight in each case. In this embodiment two displaceable weights are thus used. If all drives of the work machine are electric drives, no further installation space is required in addition to electric energy storage devices, such as for oil tanks, pumps and valves. Electrical energy storage systems can be easily divided between two remote rooms without incurring significant constructional expenses. The effort is largely limited to the use of electrical cable connections.

In a preferred embodiment, the two displaceable weights are fixedly connected to each other at their rear end. This allows them to be moved by a single drive element or a single actuator. A single control signal is thus sufficient for this. Since the connection of the two displaceable weights is arranged at the rear end of the vehicle, the movements of the elements of the other movement channels such as the pivot arm and the working arm as well as the rod systems are not disturbed.

A further work machine according to the invention comprises a further work unit or a further holder for a further working unit. Furthermore, the further work machine according to the invention comprises precisely one further main vehicle axle, wherein further wheels are arranged on both sides of the further main vehicle axle. A separate further drive unit is assigned in each case to the further wheels arranged on both sides of the further main vehicle axle. Furthermore, the further work machine according to the invention comprises at least one further auxiliary wheel, the further auxiliary wheel comprising at least one device for detecting the load.

Furthermore, the further work machine according to the invention comprises a further displaceable weight, wherein the position of the further displaceable weight can be regulated via a control system in such a way that the load on the further auxiliary wheel lies within a lower and upper limit value. Furthermore, the further work machine according to the invention comprises at least one control system, the control system comprising at least one control loop which, when the load on the further auxiliary wheel falls below the lower limit value, actuates the further drive units in such a way that the applied drive torque is changed in such a way that the vehicle is thereby prevented from tipping over. For this purpose, vehicles with a further displaceable weight and a further displaceable working unit are to be used.

A preferred embodiment of the further work machine according to the invention thus has two driving modes. In the self-balancing driving mode, the further auxiliary wheel is not on the ground. The vehicle balances around the further main vehicle axle with the aid of tilt sensors and is controlled by the amount of torque and speed of the further wheels on the further main vehicle axle and by the positional displacement of the further displaceable weight. In the driving mode of the additional auxiliary wheel, on the other hand, the additional auxiliary wheel is on the ground and takes on a load that is determined by load sensors and can be controlled by a position displacement of the additional displaceable weight within an upper and lower limit value.

The further work machine according to the invention thus has the option of always placing the main load on the further main vehicle axle and keeping the load on the further auxiliary wheel in an area that can be predefined by the limit values. Due to the low load on the further auxiliary wheel, the maneuverability of the further work machine in this driving mode remains similarly good as in the driving mode self-balancing. However, the demands on control and controllability are higher in self-balancing, especially in difficult terrain. In this case, the control speed available to the vehicle for driving on two wheels may be too slow. The rapidly changing forces that can act on the further work machine as a result of the further work unit, or forces that can act impulsively on the further wheels as a result of a very uneven road surface, can be better controlled if the further auxiliary wheel takes over a proportion of the load, even if this proportion is significantly lower than that of the further wheels of the further main vehicle axle.

Furthermore, when balancing in difficult terrain or standing on two more wheels, the vehicle requires more energy for the further drive units. For a modern ecological further work machine, the optimal use of energy is an essential requirement. Thus, the self-balancing driving mode is suitable for driving on even road surfaces and at higher driving speeds. The advantage is that the vehicle does not experience pitching accelerations and pitching movements due to road unevenness in the driving mode Self-balancing. The additional energy consumption of the other drive units required for balancing is low at higher driving speeds. The driving mode auxiliary wheel, on the other hand, is suitable for driving on uneven road surfaces, with rapidly changing forces that can act on the further work machine, for example, due to the further working unit, when driving slowly and when stationary.

In order to keep the load on the further auxiliary wheel small and thus keep the maneuverability and agility of the further work machine similar to that of driving in self-balancing driving mode, a control loop in the control system of the further work machine according to the invention detects the load on the further auxiliary wheel. This can be done by load sensors arranged on the further auxiliary wheel or on a further holder for the further auxiliary wheel. This load changes as the additional displaceable weight is displaced. As the further displaceable weight is moved further away from the further main vehicle axle, the load on the further auxiliary wheel increases. If, on the other hand, it is moved closer to the further main vehicle axle, this load decreases. Thus, the control loop is able to vary the load on the further auxiliary wheel so that it is within a range characterized by a lower and an upper limit.

However, the speed of this control loop is limited mainly by the fact that the further displaceable weight takes time to displace. For this, frictional forces must be overcome, as well as the inertial force of the further displaceable weight, which counteracts the displacement force. If, for example, the further work machine is driving on an uneven road surface and impact-like forces are acting on the further wheels of the further main vehicle axle, then the load on the further auxiliary wheel can also decrease impact-like. If this load reaches zero, the vehicle is in danger of tipping over before this load can be increased by moving the further displaceable weight. This can be counteracted by setting the lower limit value for the load high. This means that the height of the lower limit value is also a safeguard against the vehicle tipping over.

In the further work machine according to the invention, in contrast to the work machines of the prior art, the lower limit value can be selected very low, since the further drive units of the further wheels of the further main vehicle axle are used to prevent the vehicle from tipping over if the lower limit value is quickly undershot. By selecting further drive units for this purpose that can change their torque very quickly, as is the case with electric motors, for example, an additional, fast-acting control loop can be created. Similar to the control loop that uses the displacement of the additional displaceable weight to adjust the load on the additional auxiliary wheel, the second control loop uses the change in the torques of the additional drive units to either prevent the vehicle from tipping over when the additional auxiliary wheel is already in the air or when the load on the additional auxiliary wheel moves downwards in a jerky manner so quickly that the movement of the additional displaceable weight, which is too slow for this purpose, cannot prevent the lower limit value from being undershot.

The second control loop can thus be used to compensate for the low control speed of the first control loop, and a vehicle can be created which can be operated in the driving mode auxiliary wheel, and is thus nevertheless very agile and maneuverable on uneven road surfaces. If, for example, the further work machine according to the invention drives on an uneven roadway in the forward direction, i.e. in the direction of the vehicle side opposite to the further auxiliary wheel, and has a substantially constant drive torque applied to the further drive units of the further wheels of the further main vehicle axle, then the further displaceable weight is at a constant position which is adjusted so that the load on the further auxiliary wheel is slightly above the lower limit value. If this further work machine drives through a pothole or a depression in the roadway, for example, the load on the auxiliary wheel decreases abruptly. The load reduction is detected by the load sensors on the further auxiliary wheel and reported to the control system. The further displaceable weight is immediately accelerated and moves to the rear.

Specifications such as front, rear, top and bottom are based on the further work machine used in accordance with the rules, which stands at the bottom on the ground and lifts the further working unit off the ground, for example, and moves it forwards to the front and backwards to the rear.

However, the additional auxiliary wheel can still lift off the ground. The second control loop then superimposes an additional drive torque on the drive torques already applied by the additional drive units, whose level depends on the preceding driving resistances. The higher drive torque causes the further work machine to accelerate forward. This results in a reaction torque at the further drive units, which acts on the further work machine in the direction in which the further work machine wants to tip backwards, or in which the further auxiliary wheel is pressed downwards. This prevents the further work machine from tipping over to the front.

For this second control loop, in addition to the load sensors for the load on the further auxiliary wheel, the tilt sensors provided for the self-balancing control loop can also be used. These detect the tilting motion of the vehicle when the further auxiliary wheel is already off the ground. They also detect whether the higher drive torque causes the vehicle to straighten up again, or whether the superimposed torque needs to be increased even further. Thus, inclination sensors together with the further drive units are part of the control loop in the driving mode auxiliary wheel.

If, for example, the vehicle according to the invention drives backwards, i.e. in the direction of the further auxiliary wheel, and a torque is present in this driving direction, which depends on the driving resistances, then this drive torque must also be changed when driving through a pothole in order to avoid tipping over. In this case, however, the existing drive torque is lowered to obtain the same effect as for forward driving.

In a preferred embodiment of the further work machine according to the invention, this superimposed torque, which prevents the vehicle from tipping over, is applied only until the load on the further auxiliary wheel is again above the lower limit value. Since the further displaceable weight is also displaced backwards at the same time when a value below this limit value is detected, the duration of the superimposed torque can be kept short. Thus, excessive acceleration of the vehicle speed is avoided. Similarly, the position sensors can also be used to determine the time at which the superimposed torque is reversed, as they can indicate that the vehicle has straightened up enough for the further auxiliary wheel to be on the ground again. If the additional auxiliary wheel lifts off or up from the ground, it is guided back to the ground by the superimposed torque. The vehicle therefore only travels briefly on two additional wheels and is immediately returned to the auxiliary wheel driving mode, in which the additional auxiliary wheel is on the ground with a low load. The recurring return of the additional auxiliary wheel to the ground is performed as long as the control unit has a signal that is to keep the vehicle in the auxiliary wheel mode with low load, thus having selected the auxiliary wheel driving mode.

If the corresponding signal is now different, namely that a change to the self-balancing driving mode is to be made, the load on the further auxiliary wheel is reduced by displacing the further displaceable weight until it reaches zero. At the same time, the control loop required for self-balancing using the inclination sensors is now switched on.

In a further preferred embodiment of the further work machine according to the invention, the lower and upper limit values are variable. These can be selected differently, for example, depending on the road conditions or the application. The limit values can be set either by an operator who does this either via a control element on the vehicle or via a remote control. Or the change of the limit values can also be done by automatic functions designed to optimize the respective driving situation.

In another preferred embodiment, the driving speed is used to automatically optimize the limit values. In a further embodiment, the further auxiliary wheel is arranged on the further displaceable weight. This has the advantage that the load on the additional auxiliary wheel does not increase significantly when the additional displaceable weight is extended far backwards. However, it can also be arranged on the rear part of the further vehicle frame.

In a further embodiment, vehicles with displaceable weights are to be used for this purpose. These should be able to be displaced in a sufficiently wide range and thus keep the vehicle's center of gravity in an ideal range. The displacement should be possible without large energy loss. Furthermore, the displacement should be easily controllable. It should run approximately parallel to vehicle longitudinal axis. The displacement device should be simple, inexpensive and robust and should not cause excessive wear on the components used during displacement.

A third work machine according to the invention comprises a third working unit or a third holder for a working unit. Furthermore, the third work machine according to the invention comprises one or more third vehicle axles, wherein third wheel elements and/or caterpillar elements are arranged on both sides of the third vehicle axles. Furthermore, the third work machine according to the invention comprises at least a third displaceable weight, wherein the position of the third displaceable weight is displaceable in such a way that the vehicle center of gravity can be displaced therewith. Furthermore, the third work machine according to the invention comprises at least one rod system for fastening and guiding the third displaceable weight, which comprises at least three rods, a first rod being rotatably mounted on the vehicle/vehicle frame via a first hinge point and a second rod being rotatably mounted on the vehicle/vehicle frame via a second hinge point, and a third rod being rotatably connected to the first rod by a third hinge point and being rotatably connected to the second rod by a fourth hinge point. In this case, the displaceable weight is arranged rotatably or fixedly on the third rod via a fifth hinge point.

The first four hinge points are arranged in such a way that they form a polygon with at least four sides via their connecting lines. The three hinge points of the third rod are connected to each other by a first connecting line and a second connecting line, which are at a fixed angle of more than 90° to each other. The positions of the hinge points of the first and second rods on the vehicle/vehicle frame, the length of the connecting line of the first rod, the length of the connecting line of the second rod, the fixed angle and the lengths of the connecting lines of the three hinge points on the third rod are arranged in such a way that the third rod guides the third displaceable weight during displacement on a substantially straight line fixedly associated with respect to the vehicle.

Thus, in contrast to a prior art work machine, a third work machine according to the invention has a third displaceable weight which is displaceable in a very wide range, with the displacement taking place in a straight line. In a preferred embodiment, the third displaceable weight is driven by only a single drive/actuating element, which, for displacement, must overcome essentially only the forces necessary to accelerate and decelerate the third displaceable weight. The displacement path in the horizontal direction is generated by two rods that are rotatably supported by hinges, so that the two displacement paths in the horizontal direction add up. Thus, this displacement path reaches a substantial length. In this way, the center of gravity of the vehicle can be kept in a range favorable for the stability of the vehicle, even when very dynamic forces act on the vehicle via the working unit. Due to the large displacement path, the third displaceable weight can counteract these forces with a larger lever arm and can thus produce the same effect as in the case of the fixed, and in some cases significantly heavier, counterweights of work machines of the prior art.

The forces acting on the third displaceable weight due to gravity, which can be further increased by dynamic driving conditions, must be transmitted to the vehicle through the hinge points. In the third work machine according to the invention, these forces are transmitted exclusively by simple hinges, which, by a simple rotation, for example by the use of pins, allow the necessary movements to displace the weight. Such hinges can be very robust in their design. They are well protected from dust and dirt ingress, they require little maintenance, and they can ensure long durability. They also cause only comparatively low frictional losses even when transmitting high loads. These can be reduced even further if plain bushings or rolling bearings are used.

In a preferred embodiment, the rod system is arranged in such a way that it guides the third displaceable weight along a line that is arranged substantially parallel to the vehicle longitudinal axis. This gives the advantage that the weight can be displaced a long way without approaching the ground, which would compromise ground clearance, or without having to be raised a long way up, which would consume unnecessary energy and shift the vehicle's center of gravity to a higher position that is less favorable for the vehicle. In a further embodiment, however, this line may be arranged in such a way that, in addition to displacing the third displaceable weight parallel to the vehicle longitudinal axis, thereby causing a displacement of the center of gravity of the vehicle parallel to the vehicle longitudinal axis, a vertical component of movement is simultaneously included.

In a preferred embodiment, the position and length of the displacement path of the third displaceable weight makes it possible to always precisely adjust the vehicle's center of gravity above a single third vehicle axis, so that this machine can balance itself in this way. This makes it possible to steer the vehicle with the third wheels of this axle by driving the third wheels at different speeds or even with different directions of rotation. Such machines can thus be operated in a very maneuverable and agile manner.

In another embodiment, the rod system comprises a fourth rod rotatably connected to the displaceable weight at one end by another hinge point and rotatably connected to the second rod at the other end by another hinge point. Thereby, the second rod has a third hinge point, wherein the three hinge points of the second rod are connected by a first connecting line and a second connecting line, which are at a fixed angle of more than 90° to each other. In this case, the positions of the two hinge points on the displaceable weight, the length of the third rod (by which are to be understood the connecting lines of the hinge points), the length of the fourth rod, the fixed angle and the length of the connecting line of the second rod are arranged in such a way that the fourth rod holds the third displaceable weight in a substantially horizontal position during displacement. This has the advantage that the horizontal position of the third displaceable weight does not change when displaced along the vehicle longitudinal axis. Thus, the displaceable weight may comprise components, such as motors for energy conversion, hydraulic pumps, fluid reservoirs, and/or other storage, drive, or control elements, which can operate without interference and whose function cannot be impaired by any inclined position.

In a preferred embodiment, the third displaceable weight is connected to the vehicle by two rod systems, which are arranged on two sides of the weight in such a way that the third displaceable weight has space between these rod systems and can be displaced between them. This has the advantage that a kind of tramline remains free between the two rod systems, in which the third displaceable weight can be moved back and forth. In this way, the third displaceable weight can move along the vehicle longitudinal axis in a range in which the rods are connected to the vehicle. The advantage is that this can result in very short and compact vehicles.

In a particularly preferred embodiment, the hinges of the rod systems comprise sliding bushings or rolling bearings that reduce the frictional forces generated in the bearing points of the hinges when the third displaceable weight is displaced. Thus, displacement at high dynamics can be performed quickly and without excessive energy consumption.

In a further embodiment, the third work machine comprises a control unit, wherein the control unit comprises at least one electronic control loop and thus controls the position of the third displaceable weight. This control system may comprise, for example, inclination sensors.

In a further embodiment, the third work machine comprises sensors that detect the position of the third displaceable weight. This can be evaluated, for example, in an electronic control unit and used to control or regulate the ideal position of the weight and thus the ideal position of the vehicle's center of gravity. Such sensors can be linear sensors or angular sensors, which, for example, detect an angle between two rods at a hinge point.

In a further embodiment, the third work machine comprises sensors that detect the weight of the third displaceable weight. This can provide load data to an electronic control unit that is variable, for example, by changing the weights of elements located within the third displaceable weight. For example, these may be fuel tanks, or tanks containing hydraulic fluid.

In another embodiment, the displacement is performed by a drive/actuator, which may be, for example, a hydraulic cylinder or an electric linear actuator, or an electric actuator arranged at a hinge point, such as an electric motor with a reduction gear.

In a typical embodiment, the third displaceable weight of the third work machine according to the invention comprises an energy storage device and/or an energy conversion motor. An energy conversion motor may, for example, be an internal combustion engine as known in the prior art. Furthermore, this also includes other known devices for energy conversion, such as hydraulic pumps. The energy storage device may be, for example, an accumulator for storing electrical energy. The energy provided by the energy storage device and/or the motor for energy conversion can be used not only for the traction drive, but also for hydraulic motors and/or pumps for controlling the displacement of the weight or for the movements of the third working unit. This results in the advantage that the weight of, for example, an energy storage device, when displacing the displaceable weight, simultaneously serves to displace the center of gravity. This means that comparatively lightweight vehicles can be produced.

In a preferred embodiment of the third work machine according to the invention, an auxiliary wheel can be arranged on the third displaceable weight. The advantage of such an auxiliary wheel is that it can be used, for example, to absorb load peaks. Such load peaks can arise, for example, when the third work machine is used as a working unit a bucket for breaking off material, for example in a quarry wall, or during unloading of the bucket when the load on the bucket is abruptly reduced by the falling out of material to be loaded. For this purpose, the auxiliary wheel can be used as an additional support element in an embodiment in that the control system allows a small load to be applied to the auxiliary wheel as well, so that the center of gravity is allowed to be displaced outside the third vehicle axle toward the third displaceable weight for a short time (in particular during a loading process). In addition, the auxiliary wheel can prevent the third displaceable weight from hitting the ground as a result of the abrupt displacement of the center of gravity (for example, when unloading the bucket) of the third work machine or from dragging on the ground in the event of such an abruptly required positional displacement. Thus, one advantage of the auxiliary wheel is that it can be used as an additional support point for the third work machine, particularly during loading and unloading, when abrupt load peaks and resulting displacements of the center of gravity can occur. It should be noted, however, that the main load should always be carried by the third vehicle axle, so that the auxiliary wheel and its bearing/suspension in and/or on the counterweight need only be dimensioned for light loads. Furthermore, the auxiliary wheel can prevent, for example, the displaceable weight from touching down on the ground in the event of an emergency braking of the third work machine, in which case the third displaceable weight of the third work machine must be moved abruptly against a direction of travel of the third work machine.

In a further embodiment, the working unit is arranged to the third work machine via a mount which can be rotated about the vertical axis of the vehicle and which thus permits a steering movement of the vehicle. Prior art vehicles are known which can accommodate attachable and detachable working units. In the uncoupled state, the third work machine drives and steers by means of suitable devices, for example, in that one axle has steerable wheels. Alternatively, it can self-balance and steer via different speeds of the wheels on the main axle. If caterpillar drives are arranged on both sides of a main axle, the vehicle also steers via different drive speeds and it stands stable on the caterpillar drives and thus does not require balancing means. If a working unit is coupled to such a vehicle via a rotatable mount, and the working unit has track-retaining devices such as wheels, then steering takes place via this swivel joint. Such steering devices are known from the prior art, for example, in articulated dump trucks, or in articulated wheel loaders. However, track-retaining devices can also be working units, which, as long as they are in working engagement, are guided in a laterally stable manner by means of plowshares or tillage tines.

If such vehicles include a third displaceable weight, for example, the center of gravity of these third working units can be adjusted in such a way as to use only one driven axle, with this vehicle having the same traction capability as prior art vehicles having two or more driven axles. The displaceable weight allows the position of the center of gravity to be adjusted close to the driven axle, with that axle carrying all of the weight available to generate traction. If this support is designed in such a way that it allows movement about the vehicle vertical axis but does not allow movement about the vehicle transverse axis, then a force acting downward on the working unit, for example caused by the tillage equipment such as plowshares, can also be directed to the driven axle by displacing the displaceable weight to the side away from the working unit.

Plows are known from the prior art that have a driven wheel on the side facing away from the tractor. This wheel draws power from the tractor by means of hydraulic pressure oil or by means of electric current. Thus, the force acting downward on the plowshares can be used by this driven wheel to generate a propulsive force, which thus helps the tractor to pull the plow. If a tractor has a displaceable weight, the same pulling force can be generated with the help of the single driven main axle and the driving device on the plow can be saved.

In a further embodiment, trailers can also be coupled to the third work machine according to the invention via this holder, so that the steering function of this vehicle takes place via the swivel joint. Such vehicles can also use the load of the trailer to generate tractive force on the main axle of the third work machine via the third displaceable weight. Trailers are known from the prior art that have a driven axle and in such a way use the trailer load to generate tractive force. The preloaded tractor can thus be built lighter, with the same driving performance. Due to the displaceable weight, such a driven trailer axle can be dispensed with in the third work machines according to the invention.

BRIEF DESCRIPTION OF THE DRAWINGS

Further advantages, features and details of the invention result from the following description of preferred embodiment and from the drawing; these show in FIG. 1 a work machine in the form of a wheel loader with lifting frame from the prior art;

FIG. 2 a schematic view of a work machine with displaceable weight, pivot arms and working arms from the prior art;

FIG. 8 a work machine in the form of a wheel loader from the prior art;

FIG. 9 a schematic view of a work machine in the form of a wheel loader with displaceable weight from the prior art;

FIG. 10 a schematic view of a work machine with displaceable weight from the prior art;

FIG. 11 a schematic view of a work machine in the form of a tractor from the prior art;

DETAILED DESCRIPTION

Figure 3A:
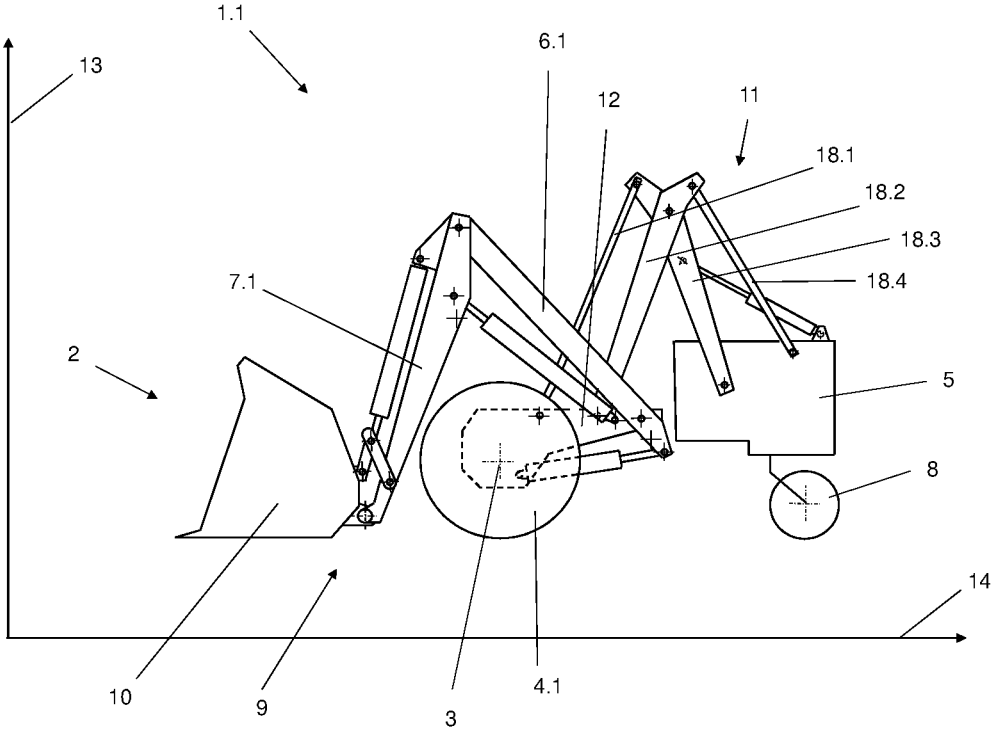
FIGS. 3*a* to 3*c* a schematic view of an embodiment of a work machine according to the invention.

FIG. 1 shows a wheel loader 50.1 corresponding to a prior art work machine/vehicle having two axles, and a working unit 52 in the form of a bucket. Furthermore, the wheel loader 50.1 comprises a lifting frame 53, which is rotatably connected at one end to the vehicle frame 55 by the hinges 54 and at the opposite end of which the working unit 52 is arranged. A counterweight 51 is fixedly arranged at the rear end. A disadvantage of such wheel loaders is that they have a high dead weight compared to their payload. They also require a lot of space for turning, given their length and the restrictions imposed by articulated steering.

FIG. 2 shows a wheel loader 50.2 corresponding to a prior art work machine/vehicle. The wheel loader 50.2 comprises only one main vehicle axle 56, on both sides of which wheel elements 57 are arranged. Separate drive units are assigned to each of the wheel elements 57, by means of which a self-balancing of the wheel loader 50.2 about the main vehicle axle 56 is effected via a control system. Via the separate drive units, the wheel loader 50.2 is also steered, whereby it can thus turn on the spot. Furthermore, the wheel loader 50.2 comprises a bucket as working unit 52, which is connected to the vehicle frame 55 via the pivot arms 60 and working arms 61. On the vehicle side facing away from the working unit 52, the work machine 50.2 has a displaceable weight 59 with which the vehicle center of gravity can be displaced and which can thus be leveled above the main vehicle axle 56. By displacing the displaceable weight 59, the vehicle can be controlled in its directions of movement in self-balancing mode.

A self-steering auxiliary wheel 58 is arranged on the displaceable weight 59. This can take a load as long as the vehicle is outside the self-balancing mode. The load on the auxiliary wheel 58 is changed by a displacement of the displaceable weight 59, which is ideally smaller than the load on the main vehicle axle 56. In such a way, it can be ensured that the wheel elements 57 of the main vehicle axle 56 always have a high contact pressure on the ground and can thus generate sufficient traction. The wheel loader 50.2 comprises two levers 62.1 and 62.2, by means of which the displaceable weight 59 is connected to the vehicle frame 55 and by means of which the adjustment of the position of the displaceable weight 59 is effected.

Two pivot arms 60 and two working arms 61 are respectively arranged on both sides of the vehicle in such a way that the working unit 52 can be pulled backwards, thus ensuring the stability of the vehicle against tipping over to the front. However, this requires the same installation space as the displaceable weight in order to be pulled far towards the main vehicle axle.

FIG. 3*a* shows a preferred work machine 1.1 according to the invention, which eliminates or at least minimizes the disadvantages of the prior art work machines. The work machine 1.1 according to the invention comprises a working unit 2, which is connected to the vehicle via the holder 9. Via the holder 9, the working unit 2 can be lifted for transport. The working unit 2 shown is a bucket 10 of the type used on wheel loaders. However, as a working unit 2 arranged on the holder 9, all working units used in the construction industry and/or in agriculture and requiring a carrier vehicle are conceivable. Furthermore, the work machine 1.1 comprises at least one main vehicle axle 3 with wheel elements 4 and/or track elements arranged on both sides.

The work machine 1.1 according to the invention can be used as a robot. In this case, the machine operates without a driver, i.e. remotely controlled and/or autonomously. Robots, such as those used in agriculture, are often lighter and smaller than the work machines as they are mostly used today. By using several of such robots to perform the work of a single work machine, and by being faster and more agile, they can be smaller and lighter and still deliver the same performance. Advantageously, they have lower manufacturing costs and lower operating costs, as well as being maneuverable and agile.

Furthermore, the work machine 1.1 according to the invention comprises a displaceable weight 5 connected to the vehicle frame 12 via a rod system 11. Here, the rod system 11 is arranged in such a way that the displaceable weight 5 can be displaced in such a wide range so that the displaceable weight 5 can be brought very close to the main vehicle axle 3 and that the vehicle is thus very compact. Due to the wide displaceable range, the displaceable weight 5 can be comparatively small and still compensate for the weight of a heavy working unit 2 via the leverage effect when this is lifted without the vehicle losing its stable position. These rods guide the displaceable weight along the vehicle longitudinal axis 14 in a substantially straight line. Little energy is expended during displacement, since the drive essentially only has to apply the acceleration energy for the displaceable weight.

In a preferred embodiment of the work machine 1.1 according to the invention, the displaceable weight 5 comprises elements such as energy converters, electric batteries or hydraulic systems for supplying the hydraulic cylinders.

Furthermore, the work machine 1.1 according to the invention has pivot arms 6.1 and 6.2 which are rotatably mounted on the vehicle frame 12. Also rotatably mounted on the pivot arms 6.1 and 6.2 are working arms 7.1 and 7.2, which comprise a holder 9 on which a working unit 2 can be arranged.

Figure 3B:
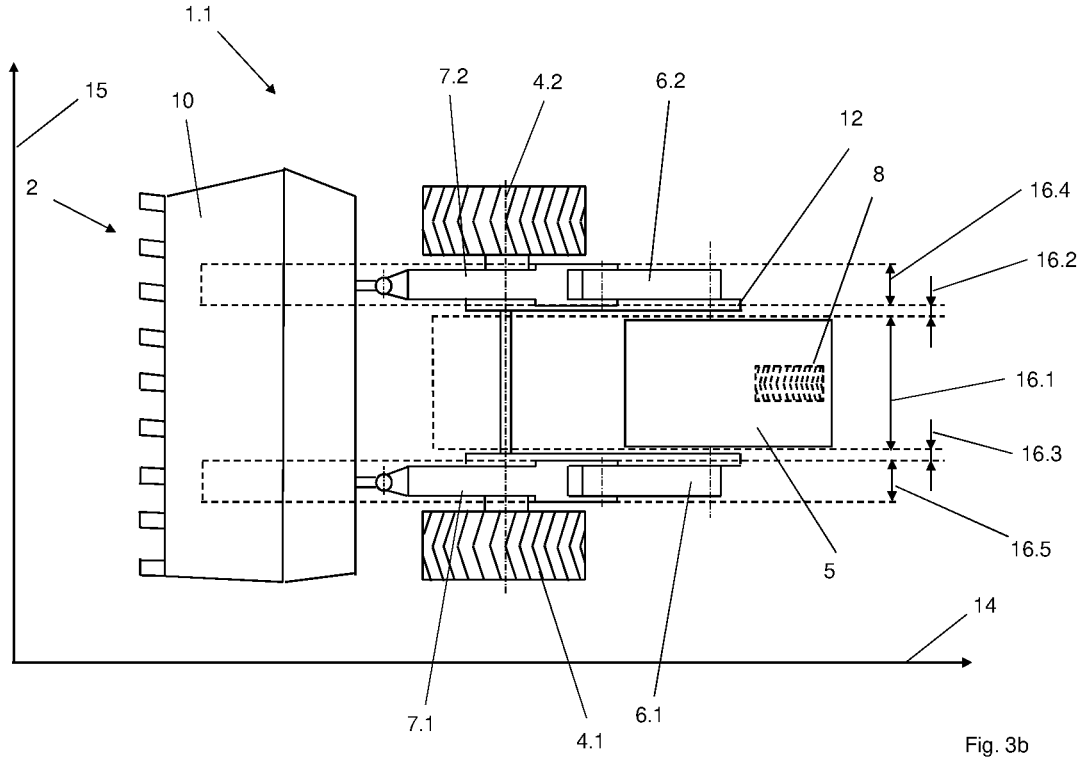

FIG. 3*b* shows a further view of the work machine 1.1 according to the invention. In order to be able to pull the displaceable weight 5 along the vehicle longitudinal axis 14 far towards the area of the main vehicle axis 3 without being obstructed by other elements in the vehicle, a first movement channel 16.1 is assigned to the displaceable weight 5. There are no other elements in the first movement channel 16.1, regardless of their movements or positions. The displaceable weight 5 and thus the first movement channel 16.1 assigned to it takes up a central position on the vehicle transverse axis 15.

Since in a preferred embodiment the displaceable weight 5 contains in its interior functional elements such as energy accumulators, energy converters, hydraulic pumps, valves and hydraulic oil accumulators, it takes up a comparatively large extension in the direction of the transverse axis 15 of the vehicle. Ideally, only a single displaceable weight 5 is used, but several smaller ones may well be used, in which case they need not be centered.

In the preferred embodiment, a rod system 11.1 and 11.2 is arranged on each side of the displaceable weight 5, consisting of four rods 18.1, 18.2, 18.3 and 18.4. The rod systems 11.1 and 11.2 are assigned the two second and third movement channels 16.2 and 16.3 to ensure their movements in the direction of the main vehicle axis 3. In the preferred embodiment, the two pivot arms 6.1 and 6.2 and, lying in the same level, the two working arms 7.1 and 7.2 are attached to the vehicle frame 12 further out in the direction of the vehicle transverse axis 15. In this case, the two pivot arms 6.1, 6.2 and the assigned two working arms 7.1, 7.2 move in the same level. The two fourth and fifth movement channels 16.4 and 16.5 are assigned to them. The width of these fourth and fifth movement channels 16.4, 16.5 can thus be kept very small.

Figure 3C:
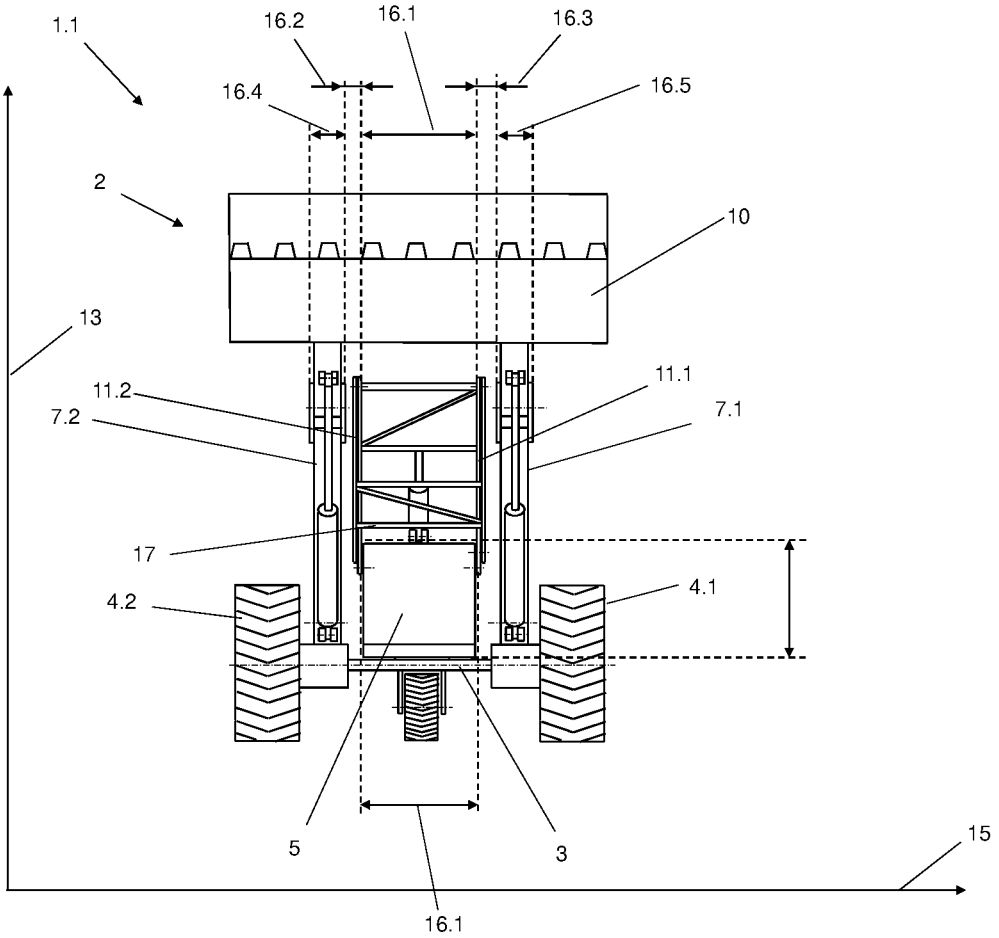

FIG. 3*c* shows a further view of the work machine 1.1 according to the invention. The first movement channel 16.1 is bounded at the bottom by the main vehicle axle 3. In the retracted state, the displaceable weight 5 is thus located above the main vehicle axle 3. Towards the top, the displaceable weight 5 takes up as much space as is given by the inner elements. Above this, the rod systems 11.1 and 11.2 can be connected to each other by cross rods 17, thereby achieving great stability. Thus, the rods 18.1, 18.2, 18.3 and 18.4 can be dimensioned very small and space-saving in the direction of the vehicle transverse axis 15. As a result, the second and third movement channels 16.2 and 16.3 thus take up very little installation space in this direction. The advantage is that the work machine 1.1 can thus be built comparatively narrow.

Figure 4:
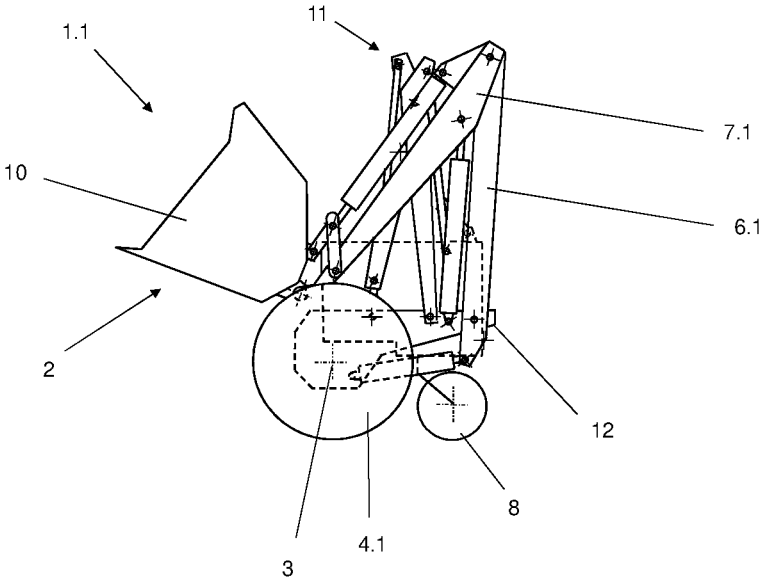
FIG. 4 a schematic view of an example of a work machine according to the invention.

FIG. 4 shows the work machine 1.1 according to the invention in its short state. Here, the working unit 2 is in a position that extends far to the main vehicle axle 3. At the same time, the displaceable weight 5 is in a position that reaches far up to the main vehicle axle 3, or is partially above it. Thus, a very compact vehicle is provided.

Figure 5:
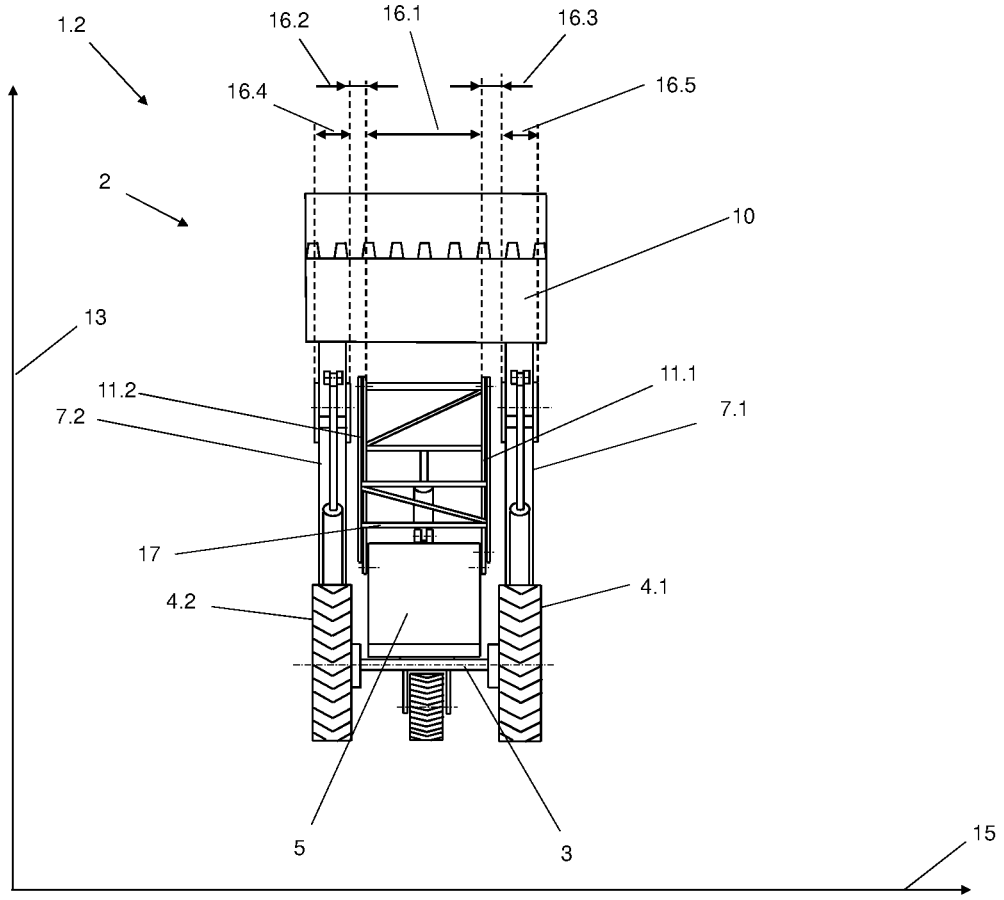
FIG. 5 a schematic view of a further embodiment of a work machine according to the invention.

FIG. 5 shows a further embodiment of the work machine 1.2 according to the invention. Here, the wheel elements 4.1 and 4.2 are located in the same region in the direction of the vehicle transverse axis 15 as the pivot arms 6.1, 6.2 and working arms 7.1, 7.2. The advantage is that the vehicle width can thus be kept very small. At locations inside buildings, the work machine 1.2 can drive through narrow corridors or through narrow doorways.

Figure 6A:
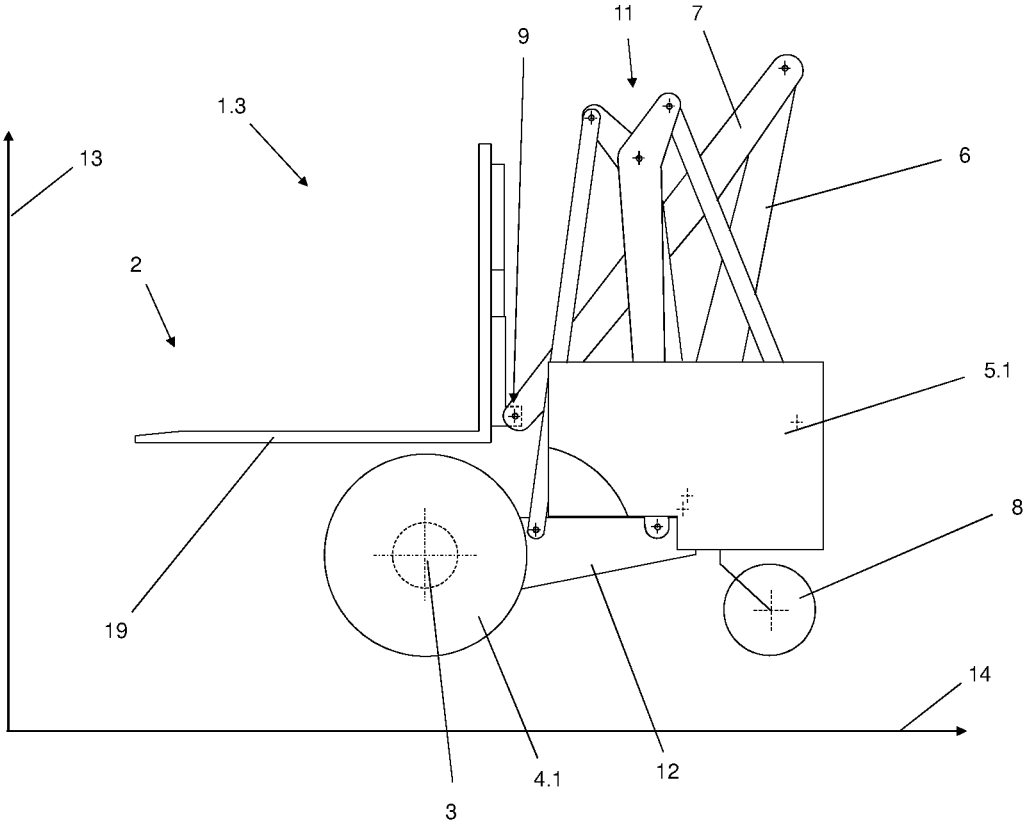
FIGS. 6*a* to 6*d* a schematic view of an embodiment of a work machine according to the invention.

FIG. 6*a* shows a further work machine 1.3 according to the invention, which eliminates or at least minimizes the disadvantages of the prior art work machines. The work machine 1.3 according to the invention comprises a working unit 2. The working unit 2 shown is a forklift fork as used in the prior art forklifts. However, any working unit used in construction and/or agriculture that requires a carrier vehicle is conceivable as a working unit 2 arranged on the holder 9. The working unit 2 or the holder 9 for a working unit is arranged on a vehicle frame 12 by means of at least one pivot arm 6 with at least one working arm 7 rotatably mounted thereon. In the work machine 1.3 according to the invention, the pivot arm 6 and the working arm 7 take up a central position on a vehicle transverse axis 15. By using only one pivot arm and only one working arm, their movements can be performed by only a few drives/actuators. This results in a low vehicle weight and low manufacturing costs. This makes it possible to use electrical actuators, which are expensive in detail. However, their higher costs do not have an unfavorable effect on the overall costs of the work machine due to the low number.

Furthermore, the work machine 1.3 according to the invention comprises two displaceable weights 5.1, 5.2. These are connected to the vehicle frame 12 via two rod systems 11.1, 11.2. The rod systems 11.1, 11.2 are arranged in such a way that the displaceable weights 5.1, 5.2 can be displaced over a wide range. This means that they can be moved very close to the main vehicle axle 3, making the vehicle very compact. Due to the wide displaceable range, the displaceable weights 5.1, 5.2 can be comparatively small and still compensate for the weight of a heavy working unit 2 via the leverage effect when this is lifted without the vehicle losing its stable position.

Figure 6B:
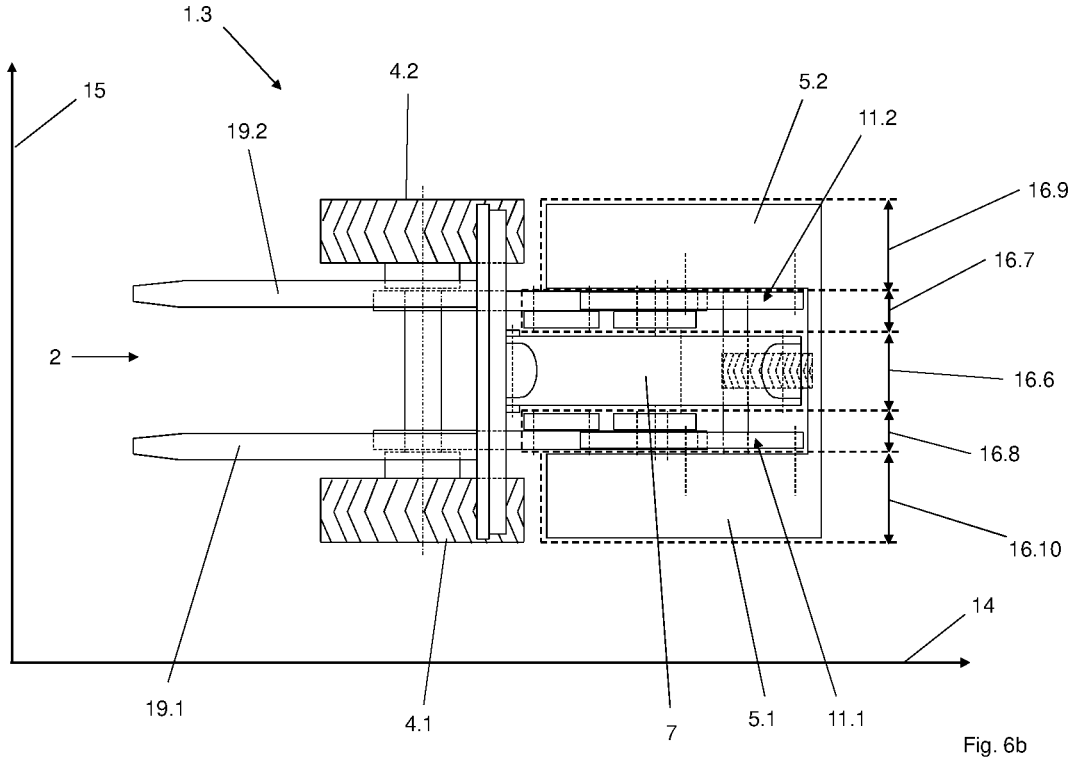

FIG. 6*b* shows a further view of the work machine 1.3 according to the invention. In order to be able to pull the working unit 2 along the vehicle longitudinal axis 14 far beyond the main vehicle axis 3 without the pivot arm 6 and the working arm 7 being obstructed by other elements in the vehicle, a sixth movement channel 16.6 is assigned to the pivot arm 6 and the working arm 7. There are no other elements in the sixth movement channel 16.6, regardless of their movements or their position.

On both sides of the pivot arm 6 and the working arm 7, a rod system 11.1 and 11.2 are arranged in the preferred embodiment. The two rod systems 11.1 and 11.2 are assigned the two seventh and eighth movement channels 16.7 and 16.8 to ensure their mobility in the direction of the main vehicle axis. In the preferred embodiment, the displaceable weights 5.1 and 5.2 are arranged further out in the direction of the vehicle transverse axis 15. In this case, the displaceable weights 5.1 and 5.2 move in the two ninth and tenth movement channels 16.9 and 16.10 assigned to them. This has the advantage that the displaceable weights 5.1, 5.2 can be pulled far towards the area of the main vehicle axle 3. Since the sixth movement channel 16.6 is for the first pivot arm 6 and the first working arm 7, the two seventh and eighth movement channels 16.7 and 16.8 are for the rod systems 11.1 and 11.2, and the two ninth and tenth movement channels 16.9 and 16.10 for the displaceable weights 5.1 and 5.2 do not interfere with each other, the working unit 2 and the displaceable weights 5.1 and 5.2 can be pulled toward the center of the vehicle at the same time, resulting in a very compact overall length of the vehicle. Due to the short overall length, very agile and fast movements of the vehicle are achieved.

In a preferred embodiment of the work machine 1.3 according to the invention, the two displaceable weights 5.1, 5.2 are fixedly connected to each other at their rear end. This allows them to be moved by a single drive element or a single actuating element. Since the connecting elements of the two displaceable weights 5.1, 5.2 are arranged at the rear end of the vehicle, or at the rear end of the weights 5.1, 5.2, the movements of the pivot arm 6 and the working arm 7 as well as the rod systems 11.1, 11.2 are not disturbed.

Figure 6C:
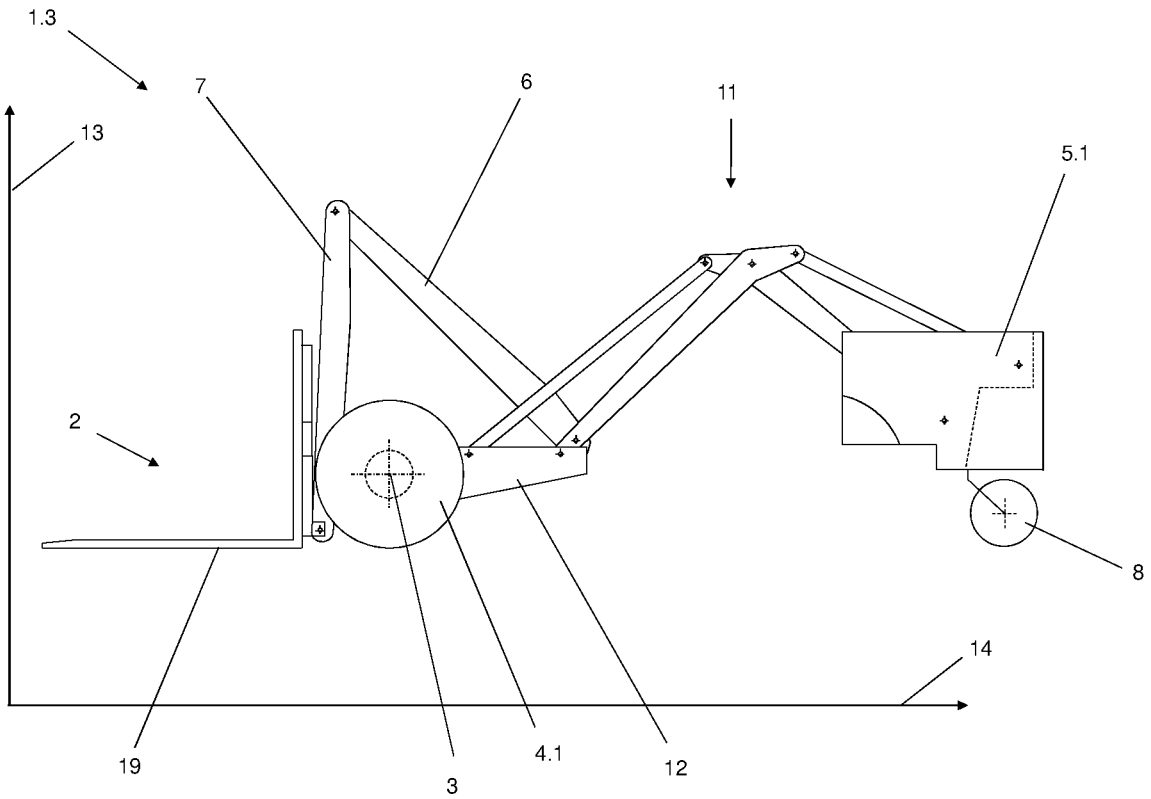

In FIG. 6*c* the work machine 1.3 according to the invention is shown in a stretched position.

Figure 6D:
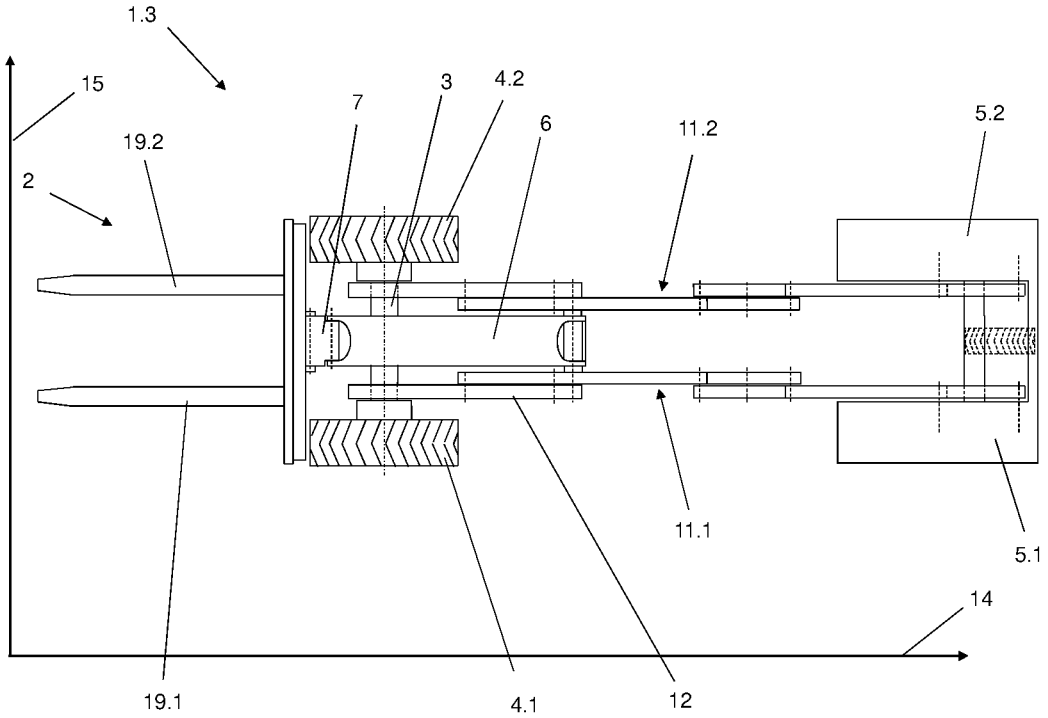

In FIG. 6*d*, the work machine 1.3 according to the invention is shown in a stretched position in a further view.

Figure 7:
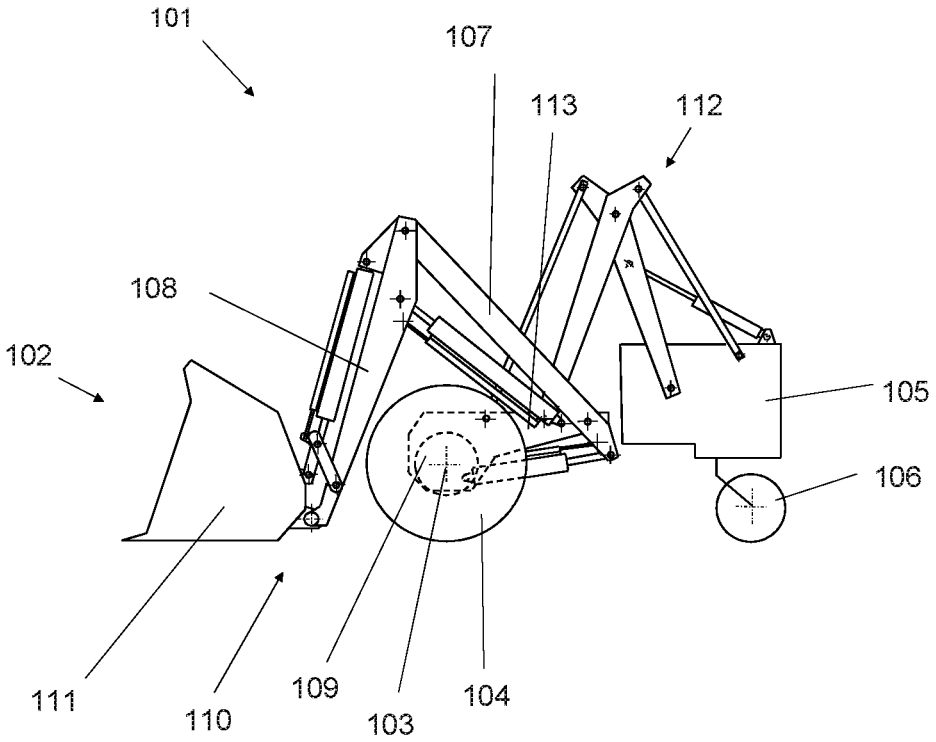
FIG. 7 a schematic view of an example of a work machine according to the invention.

FIG. 7 shows a preferred further work machine 101 according to the invention, which eliminates or at least minimizes the disadvantages of the prior art work machines. The further work machine 101 according to the invention comprises a further working unit 102, which is connected to the vehicle via the further holder 110. Via the further holder 110, the further working unit 102 can be lifted for transport. The further working unit 102 shown is a bucket 111, as used in wheel loaders. However, any working unit used in construction and/or agriculture that requires a carrier vehicle is conceivable as a working unit arranged on the further holder 110. Furthermore, the further work machine 101 comprises at least one further main vehicle axle 103 with further wheels 104 arranged on both sides.

Furthermore, the further work machine 101 according to the invention comprises a further displaceable weight 105, which is connected to the further vehicle frame 113 via a further rod system 112. Thereby, the further rod system 112 is arranged in such a way that the further displaceable weight 105 can be displaced in such a wide range so that this can be brought very close to the further main vehicle axle 103 and that the vehicle is thus very compact. Due to the wide displaceable range, the further displaceable weight 105 can be comparatively small and can nevertheless compensate for the weight of a heavy further working unit 102 via the leverage effect when the said working unit is lifted without the vehicle losing its stable position.

In a preferred embodiment of the further work machine 101 according to the invention, the further displaceable weight 105 comprises elements, such as energy converters, electric batteries or hydraulic systems for supplying the hydraulic cylinders.

Furthermore, the further work machine 101 according to the invention has further pivot arms 107, and further working arms 108, with which the further work unit 102 can be moved. An auxiliary wheel 106 is arranged on the further displaceable weight 105, which is rotatably mounted in such a way that it can make passive steering movements. The steering movements of the further work machine 101 according to the invention are made by the different speeds or directions of rotation of the further drive units 109, which drive the further wheels 104 arranged at both outer ends of the further main vehicle axle 103. Thus, the further work machine 101 can be operated in a very maneuverable and agile manner. In this case, the auxiliary wheel 6 can either be in the air. Then the further work machine 101 balances around the further main vehicle axle 103. Or the auxiliary wheel 106 is in contact with the ground, in which case it takes up a significantly lower load than the further wheels 104 of the further main vehicle axle 103. The steering movements predefined by the further drive units 109 then automatically lead to a rotation of the auxiliary wheel 106, whereby the latter is passively steered as well.

Furthermore, the holder of the auxiliary wheel 106 on the further displaceable weight 105 comprises at least one load sensor, which can measure the load, i.e. the force, acting between the ground and the auxiliary wheel. In a further embodiment, this force can also be measured at any point of the further rod system 112, in which case the weight of the displaceable weight can be taken into account.

In a further embodiment, the holder of the auxiliary wheel 106 may comprise a device for moving the auxiliary wheel upwardly in relation to the further displaceable weight 105 or in relation to the further vehicle frame 113. This increases the distance between the roadway and the auxiliary wheel 106 when balanced about the further main vehicle axis 103.

The further work machine 101 according to the invention can be operated by means of at least two driving modes. In the driving mode self-balancing, the auxiliary wheel 106 is load-free and/or is in the air. Thus, it has no contact with the roadway. The control of the further work machine 101 comprises a control loop that comprises inclination sensors, that controls the drive units 109, and that controls the further displaceable weight 105. A further driving mode, the auxiliary wheel driving mode, is that the control comprises a control loop that comprises inclination sensors and that further comprises load sensors on the auxiliary wheel, and that controls the further displaceable weight 105 and the further drive units 109. This control circuit controls the position of the further displaceable weight 105 in such a way that the load on the auxiliary wheel 106 adjusts itself above a lower limit value and below an upper limit value.

These limit values are set in such a way that the upper limit value, causes a significantly lower load on the auxiliary wheel than on the further wheels 104 of the further main vehicle axle 103. Since only these further wheels 104 have the further drive units 109, the largest proportion of the vehicle weight can thus be used to generate traction. In contrast to prior art work machines comprising four or more driven wheels, the further work machine 101 according to the invention is able to provide the same traction with only two driven wheel elements. In addition, the low load provided by the upper limit causes the further work machine 101 to have good steerability, and the lower limit is set in such a way as to prevent the further work machine 101 from tipping over to the front when driving on difficult terrain or uneven road surfaces. It is taken into account that the displacement of the further displaceable weight 105 has a reaction time, which is predetermined, by the speed of the control loop as well as the acceleration and movement speed of the further displaceable weight 105. If the lower limit value is high, then the further work machine 101 does not yet tip over when the speed falls below the lower limit value. Thus, more time is available to the control loop. In the further work machine 101 according to the invention; however, the lower limit value is selected to be low. In a preferred embodiment, this is essentially close to zero. In this case, the control loop controls the drive units with significantly less reaction time in such a way that tipping over of the further work machine 101 is thereby prevented. This is done, for example, during forward driving by increasing the drive torque of the further work machines 109. Since in a preferred embodiment of the work machine according to the invention electric motors are used as further drive units 109, which have very short reaction times for increasing their torque, the total reaction time of this control loop is also very short. Due to the higher torque, the work machine, when tipping over, can be straightened up quickly until the auxiliary wheel 106 is back on the ground. This control loop uses not only the signals from the load sensors on the auxiliary wheel 106, but also the tilt sensors, which provide usable signals even when the auxiliary wheel is already in the air. The goal of the control loop in this driving mode auxiliary wheel is not driving on two wheels, but on at least three. Therefore, if the auxiliary wheel lifts off the ground, the amount of superimposed torque on the other drive units 109 is selected in such a way that the auxiliary wheel is returned to the ground. Similarly, the time at which the further drive units 109 have an increased torque is limited to such an extent that the auxiliary wheel 106 is loaded again as quickly as possible, but without hitting the ground too hard.

The setting of the lower and upper limit value can be done either manually by an operator using either a control element or by a remote control. However, this setting can also be done by an automatic function of the control system. For example, the driving speed can be pulled for this purpose. The selection of one of the two modes can likewise be controlled either manually by an operator, for example using an operating element or a radio remote control, or by an automatic function of the control. This can, for example, take into account the driving speed, whereby at higher driving speeds, the self-balancing driving mode is more likely to be selected and at slower driving speeds the auxiliary wheel driving mode is more likely to be selected. However, other variables can also be taken into account for these specifications. For example, GPS data can identify the location of the work machine. If the machine has already been operated at the same location at an earlier time and the unevenness of the ground at this location was very great, the limit values and the switchover to the auxiliary wheel driving mode can be predefined. To detect the unevenness, sensors suitable for this purpose can also be used, such as the inclination sensors or acceleration sensors.

FIG. 8 shows a wheel loader 250.1, which corresponds to a prior art work machine/vehicle, and which has two axles. Depending on the position of the center of gravity, the load on such work machines is distributed in a certain ratio between the two axles. However, the displacements of the vehicle's center of gravity that occur during work, for example due to a load pickup in a bucket of a wheel loader, and all the dynamic forces that occur, for example caused by a braking process, are very large. In the case of a wheel loader, for example, the loaded bucket generates an additional force that lies far outside a tipping axis of the front axle. In addition, the loader must be able to apply so-called breakaway forces when filling the bucket in order to detach the material to be loaded from the pile or wall. Therefore, wheel loaders require a high dead weight for safe operation and a heavy counterweight 251 on the side of the vehicle facing away from the working unit 252. This results in a very poor load to empty weight ratio and, among other things, a very high consumption of primary energy sources by these work machines.

FIG. 9 shows a wheel loader 250.2 which corresponds to a prior art work machine/vehicle. The wheel loader 250.2 comprises only one main vehicle axle 253, on both sides of which wheel elements 254 are arranged. Separate drive units are assigned to each of the wheel elements 254, by means of which a self-balancing of the wheel loader 250.2 about the main vehicle axle 253 is effected via a control system. Via the separate drive units, the wheel loader 250.2 is also steered, whereby it can thus turn on the spot.

Furthermore, the wheel loader 250.2 comprises as working unit 252 a bucket which is connected to the vehicle frame 256 via the working arms 255.1 and 255.2. On the vehicle side facing away from the working unit 252, the work machine 250.2 has a displaceable weight 259 with which the vehicle center of gravity can be displaced and which can thus always be leveled above the main vehicle axle 253. By displacing the displaceable weight 259, the vehicle can be controlled in its directions of movement in self-balancing mode. A self-steering auxiliary wheel 257 is arranged on the displaceable weight 259. This can take up a load as long as the vehicle is outside the self-balancing mode. The load on the auxiliary wheel 257 is changed by a displacement of the displaceable weight 259, which is ideally smaller than the load on the main vehicle axle 253. In such a way, it can be ensured that the wheel elements 254 of the main vehicle axle 253 always have a high contact pressure on the ground and can thus generate sufficient traction.

The wheel loader 250.2 comprises two levers 258.1 and 258.2, via which the displaceable weight 259 is connected to the vehicle frame and via which the adjustment of the position of the displaceable weight 259 is effected. The two levers 258.1 and 258.9 of the wheel loader 250.2 each require their own drive, such as a hydraulic cylinder or an electric actuator. The drives are not shown in FIG. 9. A first drive pivots lever 258.1 around the hinge 260.1. A second drive pivots lever 258.2 around the hinge 260.2. In order to keep the displaceable weight 259 in a horizontal position while balancing forces acting on the auxiliary wheel 257, a third drive is needed to pivot the displaceable weight 259 around the hinge 260.3. In addition, the displaceable weight 259 may include elements, such as fluid containers, that require a horizontal position for trouble-free operation.

The levers 258.1 and 258.2 of the wheel loader 250.2 can be arranged centrally on the vehicle. In this case, the lever 258.1 is arranged far forward on the vehicle frame 256. The displaceable weight 259 can thereby be moved forward in such a way until it collides with the lever 258.1. Lever 258.1 thus limits the movement of displaceable weight 259 to the front. Thus, self-balancing can only occur if the working unit 252 is not pulled very far backwards, which means that the vehicle length cannot be reduced significantly. This disadvantage can be overcome by arranging the levers 258.1 and 258.2 laterally on the displaceable weight 259. Then the levers 258.1 and 258.2 are each required on both sides of the displaceable weight 259. A tramline is thus kept free in the center of the vehicle for the displaceable weight 259, allowing it to be displaced further to the front. However, such an embodiment can have the result that these levers 258.1 and 258.2 each require their own drive on both sides of the vehicle, which has a negative effect on the cost and weight for the vehicle.

In order to keep the displaceable weight 259 freely in the air against gravity, as is necessary for example in self-balancing mode, or to keep the load on the auxiliary wheel 257 low even during dynamic work processes, the levers 258.1 and 258.2 must be able to carry high loads. The same applies to the drives of the same. The drives must also move the displaceable weight 259 quickly and dynamically. At the same time, however, in addition to these dynamic loads, the steady load on the levers 258.1 and 258.2 and the drives is also created by the gravitational force acting on the displaceable weight. If hydraulic cylinders are used as actuators, which are comparatively robust and inexpensive, the pressure applied in the piston chamber will be permanently high, influenced by the load of the displaceable weight, even as long as there is no movement of the displaceable weight. If a movement is now requested by the control unit, additional hydraulic oil is pumped into the piston chamber, which must then be pre-pressurized in advance by a pump or from an accumulator element to at least the same pressure as is present in the piston chamber. This requires considerably more energy than would be needed to accelerate the displaceable weight alone. As a result, these drives are not very energy efficient. Thus, the wheel loader 250.2 comprises at least three drives/actuators, each of which is controlled independently of the others, which means that independent position sensors are also required. This means that a complex control system is required.

FIG. 10 shows a prior art work machine 250.3 comprising a displaceable weight 259 which is connected to the vehicle frame 256 via two levers 258.1 and 258.2, wherein the displaceable weight 259 is held in a horizontal position via the further levers 258.3, 258.4 and 258.5. Thereby, a longitudinal axis of the displaceable weight 259 is always kept parallel to the vehicle frame 256. Thereby, the vehicle frame 256 together with the levers 258.1, 258.4 and 258.3 form a parallelogram, wherein the lever 258.4 is always parallel to the vehicle frame 256. Furthermore, the levers 258.4, 258.2 and 258.5 together with the connecting line of the hinge points 260.3 and 260.6 form a parallelogram. In this case, the connecting line of the hinge points 260.3 and 260.6 is always parallel to the lever 258.4 and thus to the vehicle frame 256. A disadvantage of this is that at least two drives 261.1 and 261.2 are still required for adjusting the levers 258.1 and 258.2 in order to displace the displaceable weight 259. The working unit of the work machine 250.3 is not shown in FIG. 10.

FIG. 11 shows a prior art work machine 250.4 comprising a displaceable weight 259 connected to the vehicle frame 256 by a scissor joint 262. The scissor joint 262 guides the displaceable weight 259 along a line 263 while maintaining it in a horizontal position. In addition, displacement can be accomplished with a single actuator/actuator 261. The gravity of the displaceable weight 259 does not have to be carried by the drive/actuating element 261 when the auxiliary wheel 257 is unloaded. However, a disadvantage of this work machine 250.4 is that the scissor joint 262 requires a linear bearing 264.1 and 264.2 at each end, on the vehicle frame 256 and on the displaceable weight 259, which is mounted on a rod/rail 265.1 and 265.2 in such a way that it can be displaced smoothly along them. In doing so, these linear bearings 264.1 and 264.2 must support high loads generated by the gravity of the displaceable weight 259. In the dusty environment of a work machine, such linear bearings are also not very robust and do require maintenance.

Figure 12:
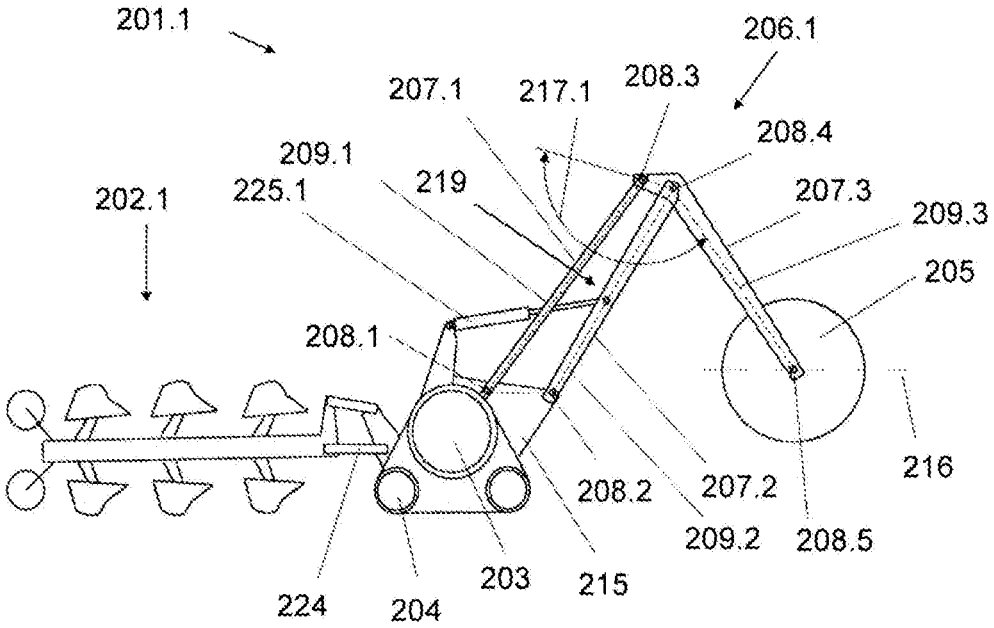
FIG. 12 a schematic view of an embodiment of a work machine according to the invention with a plow as the working unit.

FIG. 12 shows a preferred third work machine 201.1 according to the invention, which eliminates or at least minimizes the disadvantages of the prior art work machines/vehicles. The work machine 201.1 according to the invention comprises a third working unit 202.1, which is connected to the vehicle via the third holder 224. Via the third holder 224, the third working unit 202.1 can be lifted for transport. The illustrated working unit 202.1 is a plow as used in agriculture. However, any working unit used in construction and/or agriculture that requires a carrier vehicle is conceivable as the working unit 202.1 arranged on the holder 224. Furthermore, the work machine 201.1 comprises a third vehicle axle 203 with third wheel elements 204 and/or track elements arranged on both sides.

The third work machine 201.1 according to the invention can be used as a swarm robot. In this case, the machine operates without a driver, i.e. remotely controlled and/or autonomously. Swarm robots, such as those used in agriculture, are often lighter and smaller than tractors as they are mostly used today. By using several such swarm robots to perform the work of a single tractor, they can be smaller and lighter and still provide the same performance. The advantage here is that the smaller vehicle weights result in much lower soil compaction. The high soil compaction of today's tractors is often disadvantageous for agricultural soils.

Furthermore, the third work machine 201.1 according to the invention comprises a third displaceable weight 205, which is connected to the vehicle frame 215 via a rod system 206.1. Thereby, the rod system 206.1 is arranged in such a way that the third displaceable weight 205 can be displaced in such a wide range that it is neither substantially raised nor lowered and that the displacement path substantially replicates a straight line 216. Due to the wide displaceable range, the displaceable weight 205 can be comparatively small and still compensate for the weight of a heavy working unit 202.1 via the leverage effect when the said working unit is lifted.

In the third work machine 201.1 according to the invention, the third displaceable weight 205 exclusively comprises elements, such as an electric accumulator, for which it is not necessary to maintain the horizontal position. It may be fixedly attached to the rod 207.3 so that it rotates with the same angle with respect to the horizontal position as the rod 207.3 itself. The third displaceable weight 205 is shown as a circle by way of example, although it may also be cylindrical in shape. However, it can just as well take any other design.

With the rod system 206.1 of the work machine 201.1 according to the invention, the third displaceable weight 205 can be displaced with a single drive/actuating element 225.1, which is arranged, for example, in the center of the vehicle. Of course, two or more drives can also be used. The drive/actuating element 225.1 does not absorb any forces needed to hold the displaceable weight up against gravity, but only forces needed to accelerate and decelerate the weight 205, including frictional forces of the hinges that counteract movement of the third displaceable weight 205. The hinge points 208.1, 208.2, 208.3 and 208.4 are simple pin joints which can be designed to be low friction, very robust, low wear, easy to maintain and comparatively inexpensive. By design, such hinges can be well protected from dirt and dust ingress. Thus, the rod system 206.1 provides a cost-effective and energy-efficient solution for fastening and guiding the third displaceable weight 205.

Figure 13A:
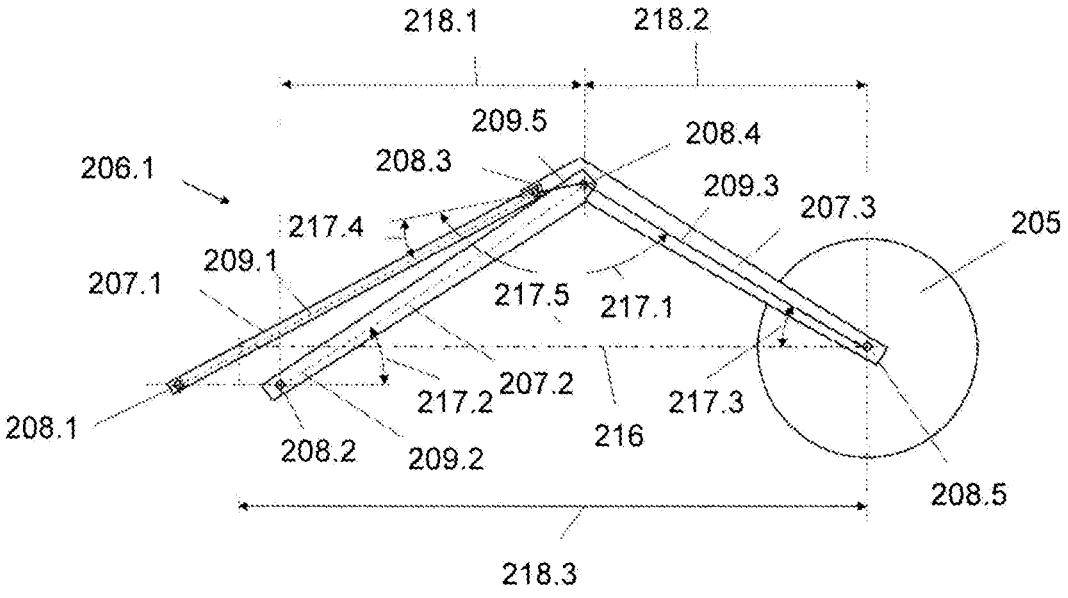
FIGS. 13*a* to 13*e* a schematic view of an embodiment of the rod system of a work machine according to the invention for displacing the displaceable weight in different positions.

FIG. 13*a* shows the rod system 206.1 of the third work machine 201 according to the invention in its fully extended position, in which the third displaceable weight 205 is deflected the furthest, i.e. is in the position furthest away from the vehicle frame. The rod system 206.1 comprises three rods 207.1, 207.2, 207.3, which are coupled to other elements by means of hinge points 208.1, 208.2, 208.3, 208.4, 208.5. Furthermore, connecting lines 209.1, 209.2, 209.3, 209.4, 209.5 are shown between the hinge points. Thus, the length of each connecting line is equal to the distance between the two hinge points connected by that connecting line. A first rod 207.1 and a second rod 207.2 are rotatably connected to the vehicle frame 215, which is not shown here, via hinge points 208.1 and 208.2. At the opposite end of each of the first rod 207.1 and the second rod 207.2 are hinge points 208.3 and 208.4, and a third rod 207.3 is arranged at these hinge points, the third rod being rotatably mounted by means of the hinge points 208.3 and 208.4 in each case. At the opposite end of the third rod 207.3, the third displaceable weight 205 is connected to the third rod 207.3 via the hinge point 208.5, wherein this connection can either be fixed or rotatably mounted. The third rod 207.3 thus comprises the three hinge points 208.3, 208.4 and 208.5, wherein the connecting line 209.5 connecting the hinge points 208.3 and 208.4 and the connecting line 209.3 connecting the hinge points 208.4 and 208.5 are at a fixed angle 217.1 to each other, which is more than 90°. The hinge point 208.5, which connects the third displaceable weight 205 to the third rod 207.3, is located in its vertical orientation on the straight line 216. In order to be able to extend the position of the third displaceable weight 205 very far, the two rods 207.1 and 207.2 must each be located at the smallest possible angle 217.2 and 217.3 to the horizontal. Thus, the two displacement paths 218.1 and 218.2 must each become as large as possible so that each of the two rods 207.2 and 207.3 makes as large a contribution as possible to the total displacement path 218.3 in the horizontal direction. However, the angle 217.5 between the second rod 207.2 and the third rod 207.3 must not become too large, but should remain considerably smaller than 180°, otherwise the forces at the hinge points 208.1, 208.2, 208.3 and 208.4 will become too large. The fixed angle 217.1 of the third rod 207.3 should be selected in such a way that the angle 217.4 between the connecting line 209.5 of the third rod 207.3 and the connecting line 209.1 of the first rod 207.1 is greater than 0°. In order to be able to comply with the specifications of a large displacement path 218.3 and to keep the angle 217.5 well below 180°, the rods 207.1, 207.2 and 207.3 have a necessary minimum length which, however, should be as small as possible so that the third work machine 201 remains limited in its overall height. Therefore, a fixed angle 217.1 greater than 90° is necessary.

Figure 13B:
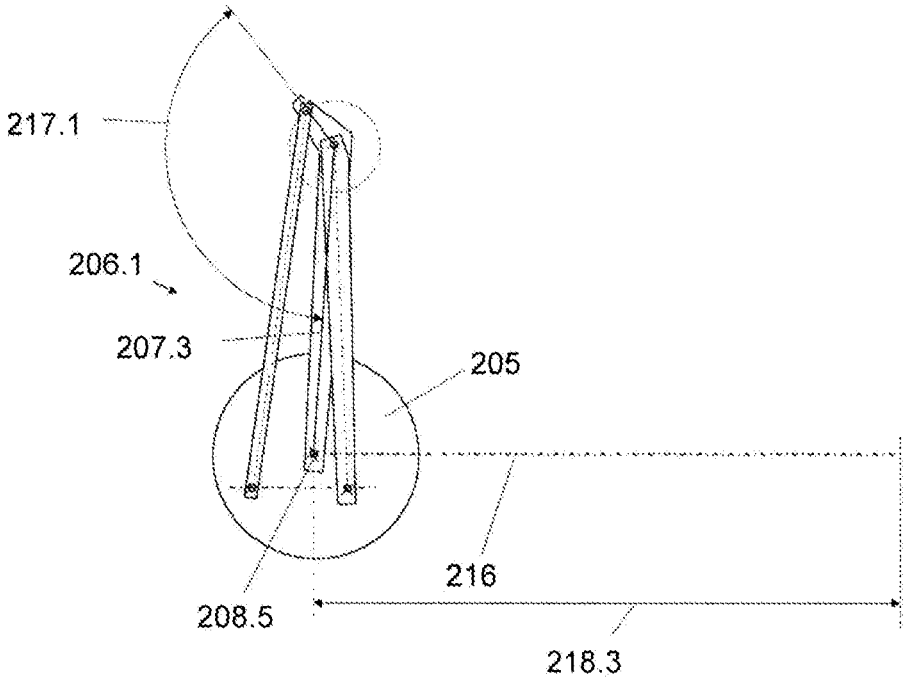

FIG. 13*b* shows the rod system 206.1 of the third work machine 201.1 according to the invention in a retracted position, in which the third displaceable weight 205 is not far deflected, i.e. is not far away from the third working unit 202, whereby the hinge point 208.5, which connects the third displaceable weight 205 to the rod 207.3, is located in its vertical alignment substantially on the straight line 216.

Figure 13C:
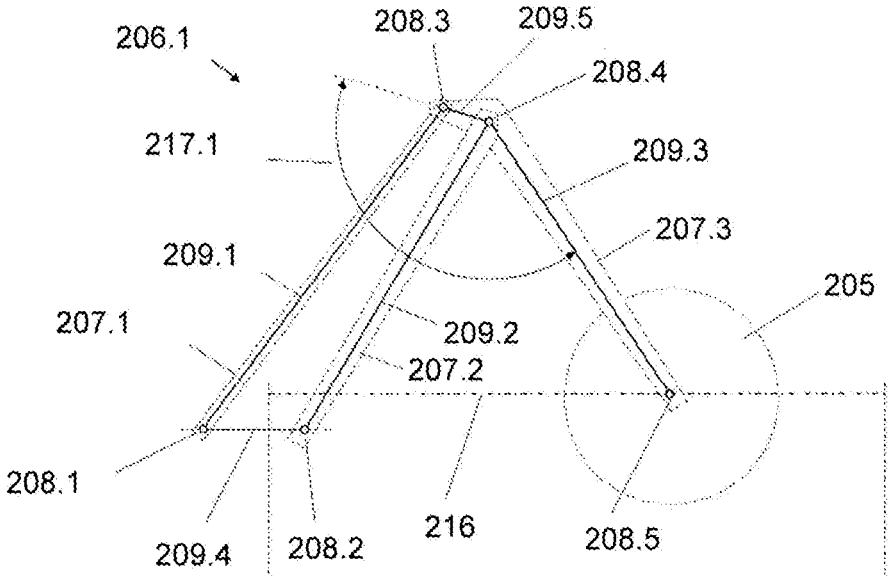

FIG. 13*c* shows the rod system 206.1 of the third work machine 201.1 according to the invention in an intermediate position, the hinge point 208.5 connecting the third displaceable weight 205 to the third rod 207.3 being located in its vertical orientation substantially on the straight line 216. The hinge points 208.1, 208.2, 208.3 and 208.4 form a polygon with four sides, the fixed angle 217.1 of the third rod 207.3 being more than 90°. The first rod 207.1 is rotatably mounted on the vehicle/vehicle frame via a first hinge point 208.1 and the second rod 207.2 is rotatably mounted on the vehicle/vehicle frame via a second hinge point 208.2, and the third rod 207.3 is rotatably connected to the first rod 207.1 by a third hinge point 208.3 and rotatably connected to the second rod 207.1 by a fourth hinge point 208.4. Here, the third displaceable weight 205 is rotatably or fixedly arranged on the third rod 207.3 through a hinge point 208.5, wherein the hinge points 208.1, 208.2, 208.3 and 208.4 are arranged in such a way that they form a polygon with four sides through their connecting lines 209.1, 209.2, 209.4 and 209.5. The three hinge points 208.3, 208.4 and 208.5 of the third rod 207.3 are connected by a first connecting line 209.5 and a second connecting line 209.3, which are at a fixed angle 217.1 of more than 90° to each other. The position of the hinge point 208.1 and the position of the hinge point 208.2 on the vehicle/vehicle frame, the length of the connecting line 209.1 of the first rod 207.1, the length of the connecting line 209.2 of the second rod 207.2, the fixed angle 217.1 and the length of the connecting lines 209.5 and 209.3 of the third rod 207.3 are arranged in such a way that the third rod 207.3 guides, via the hinge point 208.5, the third displaceable weight 205 during displacement on a substantially straight line 216 fixedly associated with respect to the vehicle.

Figure 13D:
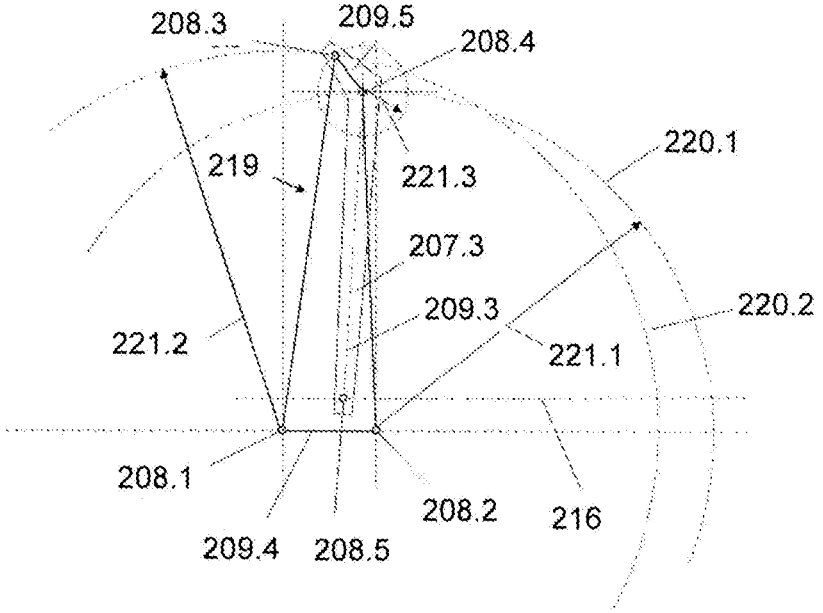

FIG. 13*d* shows the third rod 207.3 of the work machine 201.1 according to the invention with the hinge points 208.3, 208.4 and 208.5, with their connecting lines 209.3 and 209.5 and the fixed angle 217.1. It also shows the position of the polygon 219 in the retracted position of the rod system 206.1. When the third rod 207.3 rotates around the hinge point 208.2, the hinge point 208.4 moves on the circular path 220.1, whose center is the hinge point 208.2 and whose radius 221.1 is equal to the length of the connecting line 209.2 of the rod 207.2. At the same time, the hinge point 208.3 of the third rod 207.3 rotates around the hinge point 208.1, with the hinge point 208.3 moving on the circular path 220.2, whose center is the hinge point 208.1 and whose radius 221.2 is the length of the connecting line 209.1 of the rod 207.1. The third rod 207.3, which is arranged at the hinge points 208.3 and 208.4, moves along the circular paths 220.1 and 220.2 in such a way that it undergoes a rotary motion in the process, which is predetermined by the two circular paths 220.1 and 220.2.

Figure 13E:
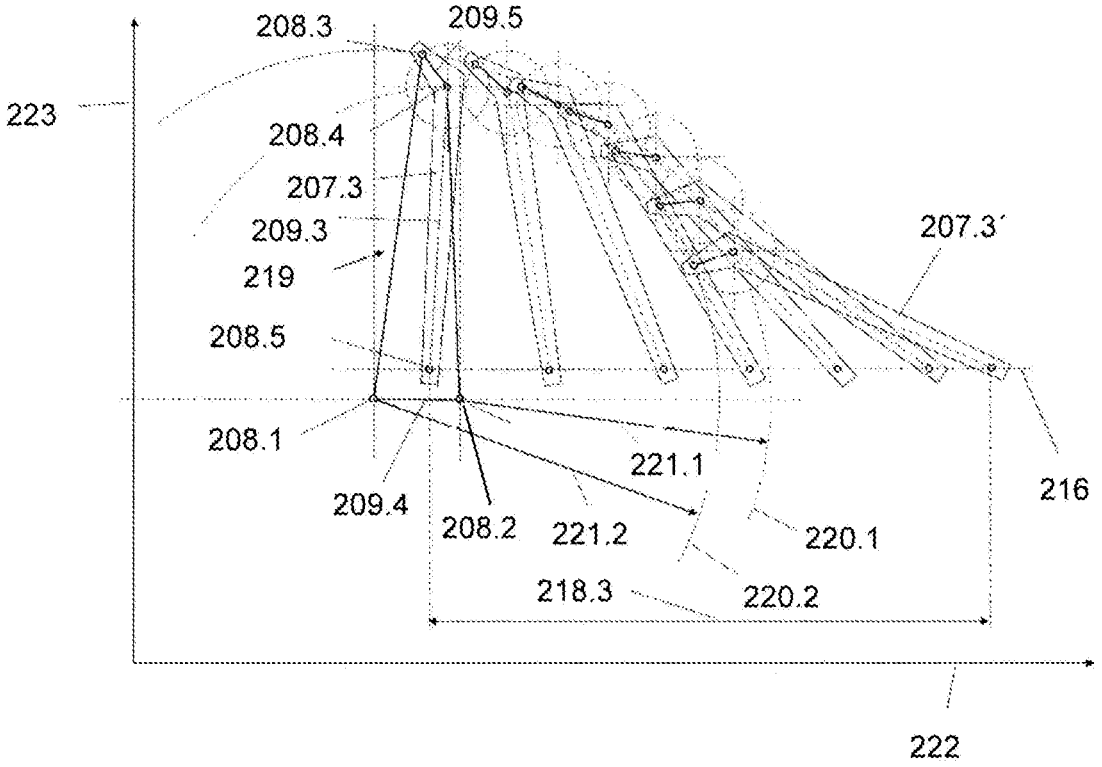

FIG. 13*e* shows the third rod 207.3 of the third working machine 201.1 according to the invention with the pivot points 208.3, 208.4 and 208.5, the connecting line 209.5 and the fixed angle 217.1 in different positions 207.3', which are predetermined by the movement of the pivot points 208.3 and 208.4 on the circular paths 220.1 and 220.2. At each of these positions, the articulation point 208.5 is substantially on the line 216. The rotation of the rod 207.3 is largely determined by the distance between the two articulation points 208.1 and 208.2, which are also the centers of the circles 220.1 and 220.2, and their different radii 221.1 and 221.2, as well as by the length of the connecting line 209.5 of the third rod 207.3. The connecting line 209.5 must be at least long enough to bridge the distance that the circular paths 220.1 and 220.2 have to each other at each point of its intended movement. When the second rod 207.2 rotates about the pivot point 208.2, the pivot point 208.4 of the third rod 207.3 rotates on the circle 220.1. In the process, this pivot point 208.4 shifts both in the horizontal direction 222 and in the vertical direction 223. Since the pivot point 208.5 of the third rod 207.3 is to move substantially along the line 216, this third rod 207.3 must rotate about the pivot point 208.4 to the extent that the pivot point 208.5 compensates for the change in the pivot point 208.4 in the vertical direction 223 due to the rotation of the third rod 207.3. To achieve this movement, the hinge points 208.1, 208.2, 208.3 and 208.4 form the polygon 219 with four sides, wherein the third rod 207.3 has three hinge points 208.3, 208.4 and 208.5, their connecting lines 209.3 and 209.5 being at a fixed angle 217.1 of more than 90° to each other. The positions of the pivot points 208.1 and 208.2, as well as the length of their connecting line 209.4, as well as the lengths of the connecting lines 209.1 and 209.2 of the first rod 207.1 and the second rod 207.2, the fixed angle 217.1 and the length of the connecting line 209.3 of the third rod 207.3 are coordinated in their magnitude so that the pivot point 208.5 is substantially on the straight line 216 in every position, within the distance 218.3 on which it can be displaced.

For example, these sizes can be selected in such a way that the positions of the hinge points 208.1 and 208.2 are on a line parallel to the vehicle longitudinal axis. Their connecting line 209.4 is 0.4 meters long. The connecting line 209.1 of the first rod 207.1 is 1.60 meters long, and the connecting line 209.2 of the second rod 207.2 is 1.45 meters long. Then, for the third rod 207.3, the connecting line 209.5 is 0.2 meters long, and the connecting line 209.3 is 1.30 meters long, wherein these are at a fixed angle 217.1 of 140° to each other. In this embodiment, the hinge point 208.5 displaces along a substantially straight line 216 for a distance 218.3 of about 2.5 meters, which is substantially parallel to the connecting line 209.4 and thus the third displaceable weight 205 can be displaced parallel to the vehicle longitudinal axis. The determination of these quantities as well as their dependence on each other can be done by graphical methods, as shown in FIGS. 13*a* to 13*e*, or by analytical methods.

Figure 14:
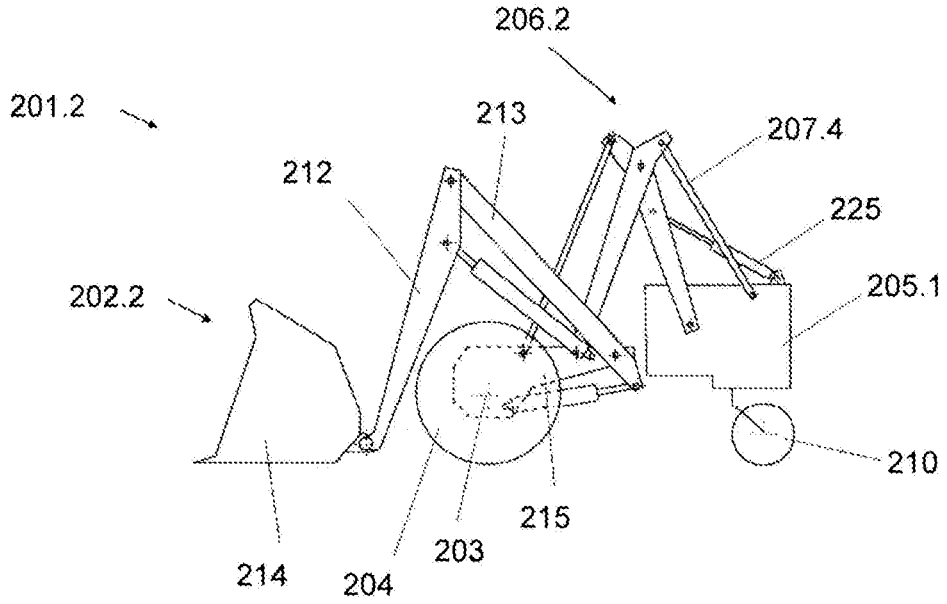
FIG. 14 a schematic view of a further embodiment of a work machine according to the invention with a displaceable weight.

FIG. 14 shows a schematic view of a further embodiment of a third work machine 201.2 according to the invention. The third work machine 201.2 according to the embodiment of FIG. 14 comprises a third main vehicle axle 203 with wheel elements 204 arranged on both sides, a working unit 202.2 in the form of a bucket 214 and a third displaceable weight 205.1, which is connected to the vehicle frame 215 by the rod system 206.2. Further, the rod system 206.2 of the third work machine 201.2 includes a fourth rod 207.4 that maintains the third displaceable weight 205.1 in a substantially horizontal position across the displaceable range.

With the rod system 206.2 of the third work machine 201.2, the third displaceable weight 205.1 can be displaced with a single drive/actuating element 225, which is arranged, for example, in the center of the vehicle wherein the fourth rod 207.4 holds the third displaceable weight 205.1 in its horizontal position. This results in the advantage that the third displaceable weight 205.1 can contain elements, such as motors for energy conversion, hydraulic pumps, fluid reservoirs and/or further storage, drive or control elements, which can operate without malfunction and whose function cannot be impaired by any inclined position. Further, an auxiliary wheel 210 may thus be attached to the displaceable weight 205.1, which may include a load sensing device.

Figure 15A:
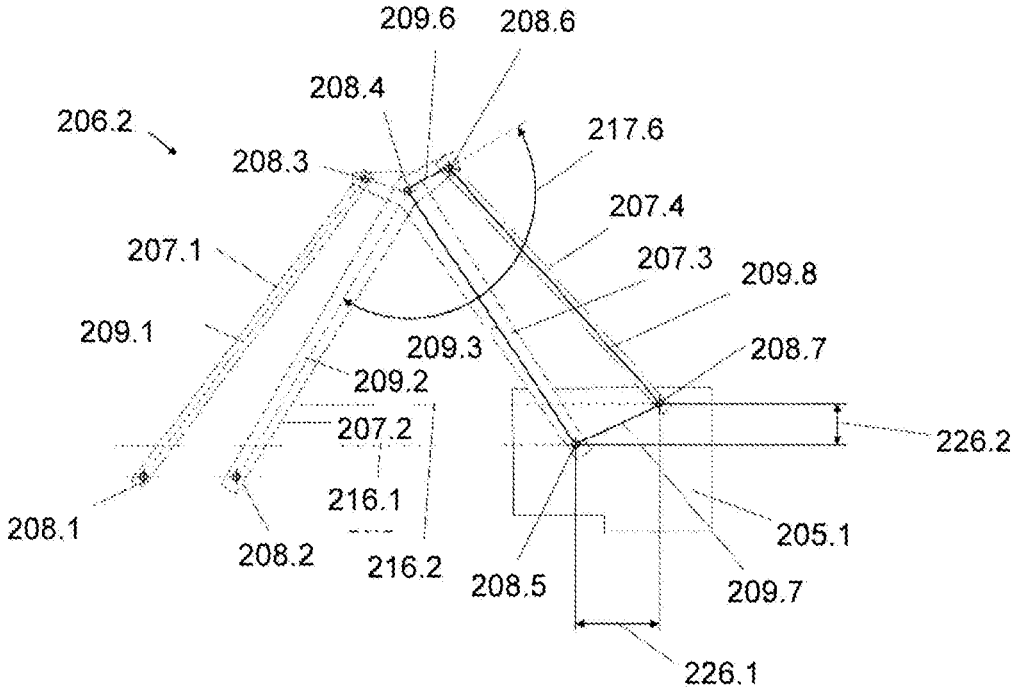
FIGS. 15*a* to 15*d* a schematic view of a further embodiment of the rod system of a work machine according to the invention for displacing the displaceable weight with a fourth rod.

FIG. 15*a* shows the rod system 206.2 of the third work machine 201.2 according to the invention in a central position. In addition to the elements of the rod system 206.1, the rod system 206.2 comprises a fourth rod 207.4, which is rotatably connected to the third displaceable weight 205.1 by a further hinge point 208.7. Through a further hinge point 208.6, the fourth rod 207.4 is rotatably connected to the second rod 207.2. Thereby, the second rod 207.2 has a third hinge point 208.6, wherein the three hinge points 208.2, 208.4 and 208.6 of the second rod 207.2 are connected by a first connecting line 209.2 and a second connecting line 209.6, which are at a fixed angle 217.6 of more than 90° to each other. The positions of the two hinge points 208.5 and 208.7 are arranged on the third displaceable weight 205.1 in such a way that they have a fixed distance 226.1 in the horizontal direction and a fixed distance 226.2 in the vertical direction. Thereby, the positions of the hinge points 208.5 and 208.7 on the third displaceable weight 205.1, the length of the connecting line 209.3 of the third rod 207.3, the length of the connecting line 209.8 of the fourth rod 207.4, the fixed angle 217.6 and the length of the connecting line 209.6 of the second rod 207.2 are arranged in such a way that the fourth rod 207.4 holds the third displaceable weight 205.1 in a substantially horizontal position when displaced.

Figure 15B:
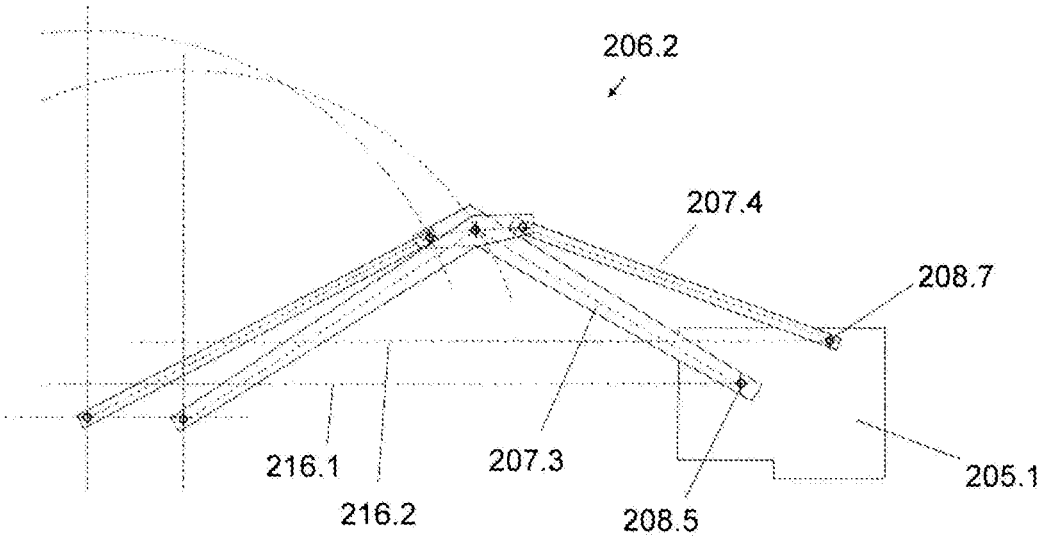

FIG. 15*b* shows the rod system 206.2 of the work machine 201.2 according to the invention in a stretched position. The hinge point 208.5, which connects the displaceable weight 205.1 to the third rod 207.3, is located on the straight line 216.1. The hinge point 208.7, which connects the displaceable weight 205.1 to the fourth rod 207.4, is located on the straight line 216.2, which is parallel to the straight line 216.1 and thus holds the displaceable weight 205.1 in a substantially horizontal position.

Figure 15C:
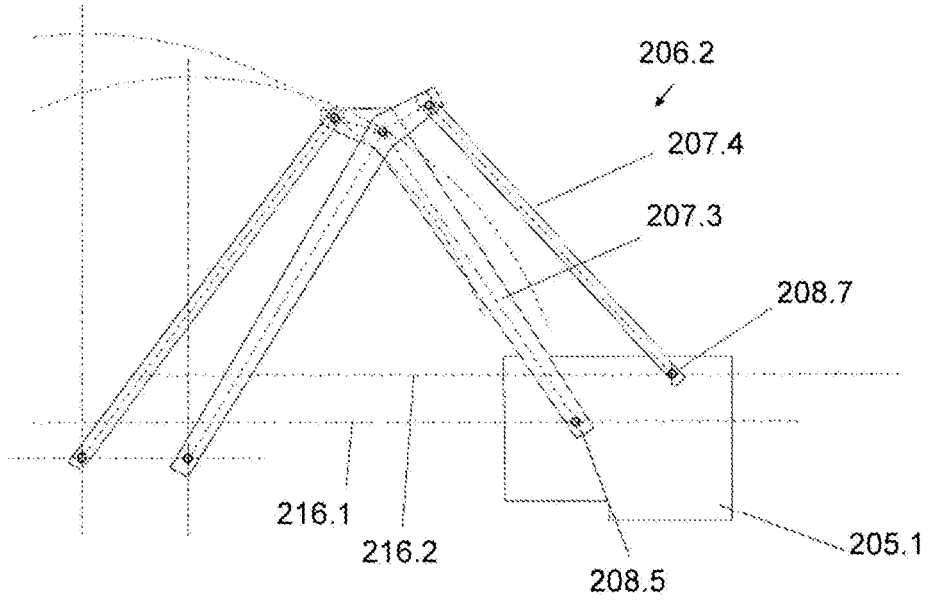

FIG. 15*c* shows the rod system 206.2 of the third work machine 201.2 according to the invention in a central position. The hinge point 208.5, which connects the third displaceable weight 205.1 to the third rod 207.3, is located on the straight line 216.1. The hinge point 208.7, which connects the third displaceable weight 205.1 to the fourth rod 207.4, is located on the straight line 216.2 and holds the displaceable weight 205.1 in a substantially horizontal position.

Figure 15D:
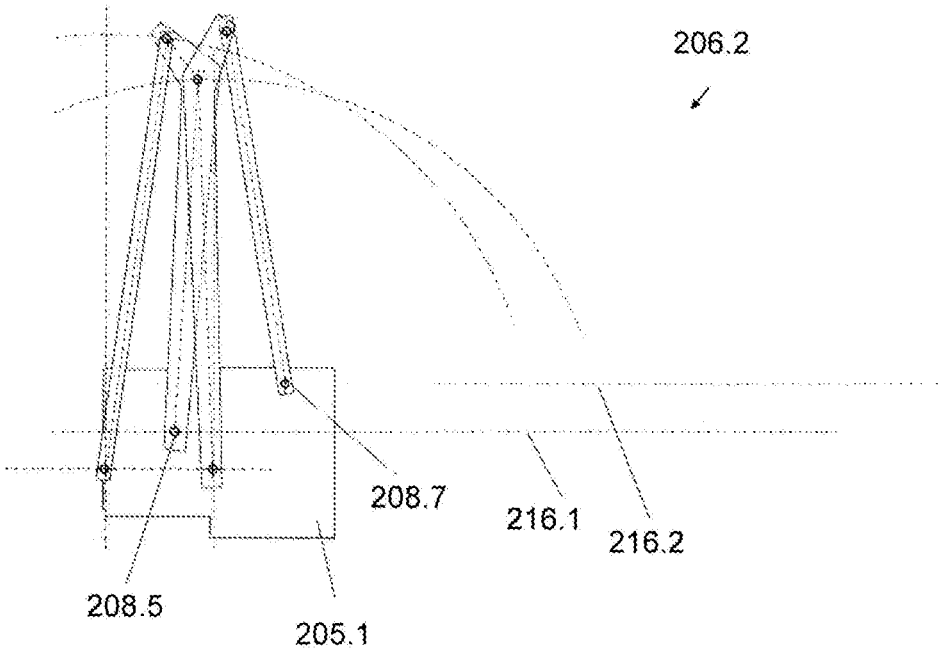

FIG. 15*d* shows the rod system 206.2 of the third work machine 201.2 according to the invention in a retracted position. The hinge point 208.5, which connects the third displaceable weight 205.1 to the third rod 207.3, is located on the straight line 216.1. The hinge point 208.7, which connects the third displaceable weight 205.1 to the fourth rod 207.4, is located on the straight line 216.2 and holds the displaceable weight 205.1 in a substantially horizontal position.

Exemplarily, these variables may be selected in such a way that the positions of the hinge points 208.1 and 208.2 are on a line parallel to the vehicle longitudinal axis. Their connecting line 209.4 is 0.4 meters long. The connecting line 209.1 of the first rod 207.1 is 1.60 meters long, and the connecting line 209.2 of the second rod 207.2 is 1.45 meters long. The connecting line 209.6 of the second rod 207.2 is 0.2 meters long and the fixed angle 217.6 of the second rod 207.2 is 150°. Then, for the third rod 207.3, the connecting line 209.5 is 0.2 meters long, and the connecting line 209.3 is 1.30 meters, wherein they are at a fixed angle 217.1 of 140° to each other. The hinge points 208.5 and 208.7 have a horizontal distance 226.1 of 0.34 meters and a vertical distance 226.2 of 0.2 meters. In this embodiment, the hinge point 208.5 displaces along a substantially straight line 216 for a distance 218.3 of about 2.5 meters that is substantially parallel to the connecting line 209.4, allowing the third displaceable weight 205.1 to be displaced parallel to the vehicle longitudinal axis. maintains the third displaceable weight 205.1 in a substantially horizontal position. The determination of these variables as well as their dependence on each other can be done by graphical methods, as shown in FIGS. 13*a* to 13*e*, as well as in FIGS. 15*a* to 15*d*, or by analytical methods.

Figure 16:
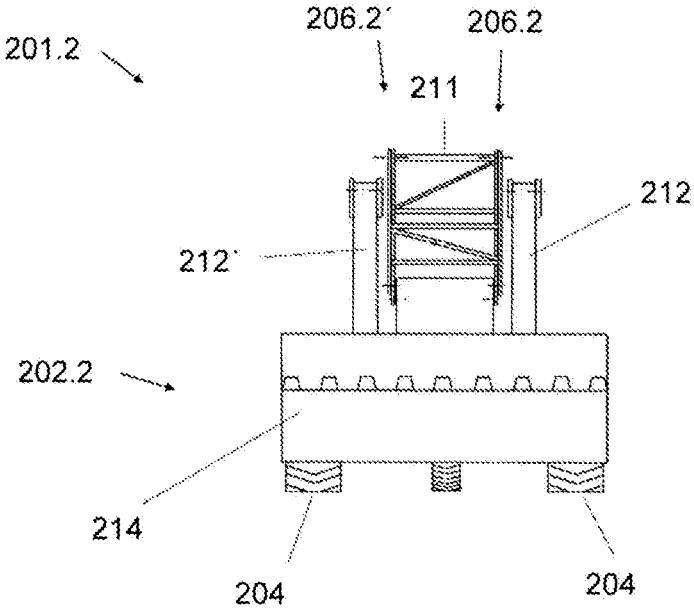
FIG. 16 a schematic view of the further work machine embodiment of the invention.

FIG. 16 shows a schematic view of the embodiment of the third work machine 201.2 according to the invention. The third work machine 201.2 comprises two rod systems 206.2 and 206.2', each of which is arranged laterally on the third displaceable weight 205.1 so that the said weight has space between the two rod systems 206.2 and 206.2' and can be displaced between them. In a area above the displaceable weight, in an advantageous embodiment, one or more cross rods 211 can be arranged to connect the two rod systems 206.2 and 206.2'. Thus, both rod systems become very robust, wherein the rods 207.1, 207.2, 207.3, 207.4 and 207.1', 207.2', 207.3', 207.4' can be manufactured in a weight- and cost-efficient manner.

Figure 17:
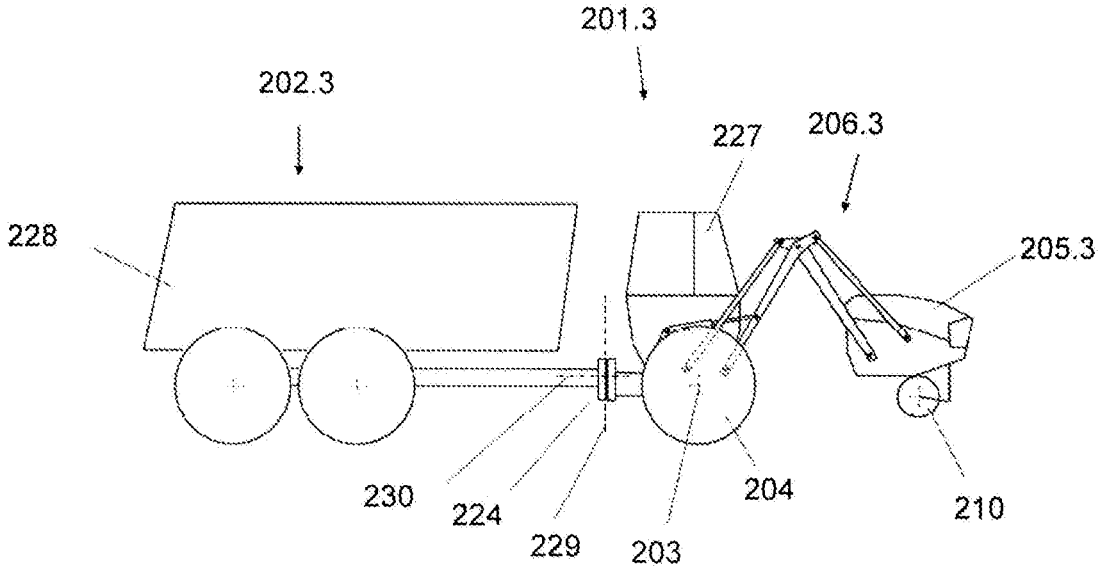
FIG. 17 a schematic view of an example of a further work machine according to the invention.

FIG. 17 shows a schematic view of a further embodiment of a third work machine 201.3 according to the invention. The third work machine 201.3 comprises a third displaceable weight 205.3, which is displaceable with two rod systems 206.3 and 206.3' (not shown) arranged laterally on the third displaceable weight 205.3. Furthermore, the third work machine 201.3 comprises a third vehicle axle 203 with laterally arranged third wheel elements 204, around which the third work machine 201.3 can be balanced. Additionally, the third work machine 201.3 comprises a holder 224 for a third working unit 202.3, which is exemplarily shown here a trailer 228. In this exemplary holder 224, the work machine 201.3 can rotate relative to the trailer 228 in such a way about the vehicle vertical axis 229 that a steering movement can be made therewith. It is also advantageous if the holder 224 allows the trailer 228 to rotate about the vehicle longitudinal axis 230, as none of the axles will then require a pendulum suspension. However, rotary motions about the transverse axis (not shown here) are not permitted by the holder 224. Such holders are known from the prior art, for example, in self-propelled, articulated dump trucks, hereinafter referred to as dump trucks. This results in the advantage that the load acting on the third vehicle axle 203 can be increased by pivoting out the third displaceable weight 205.3. Thus, the traction capacity of the third wheel elements 204 attached to the vehicle axle 203 can be increased. The resulting higher tip to the front is transferred to the trailer by the holder 224. The wheels of the trailer are accordingly relieved of load. Advantageously, such a vehicle can have similarly good traction as a comparable prior art vehicle in which one or more axles of the trailer are driven. The work machine 201.3 is thus able to make use of the weight of the trailer 228 to generate traction without the need for complex equipment such as is usually required to drive the trailer axle. This results in weight and cost advantages as well as improved energy efficiency.

Another advantage is that the holder 224 for a working unit 202.3 allows the trailer 228 to be coupled and uncoupled. Then the work machine 201.3 can be provided as a universal working unit, which can use the most diverse working units as used in construction and agriculture. If the different rotational speed or direction of rotation of the wheel elements 204 arranged on the vehicle axle 203 is used for steering, a very maneuverable and easily maneuverable vehicle is thus created, which thus has advantages even if no working unit 202.3 is attached. In order to be able to couple working units 202.3, for example a trailer 228, very easily and quickly, sensors can be used which, together with an electronic control unit, which has driver assistance systems, automatically, quickly and precisely guide the working unit 201.3 to the working unit.

Further, the third work machine 201.3 can be used with a trailer 228 in earthmoving operations in such a way that the trailer 228 is loaded while uncoupled from the third work unit 201.3. Meanwhile, the third work machine 201.3 with another trailer 228 is traveling along its intended route and does not need to wait for the loading operation. It is often the case that several dump trucks are in use between the loading point and the unloading point. For reasons of efficiency, the loading machine, for example an excavator or a wheel loader, should not have to wait until the next empty dump truck arrives. Therefore, it is often planned in such a way that the number of dump trucks used is higher than absolutely necessary. They may then have to wait at the loading point. For example, if a job site requires a certain number of dump trucks to be operated efficiently, using third work machines 201.3 is sufficient to accomplish the same task with the same number of trailers 228 but with fewer work machines 201.3. By using the displaceable weight 205.2 and the holder 224 to couple the trailers 228, these machines can be used in places where the terrain is very difficult and requires the dump trucks to have a high traction capacity.

The invention claimed is:

1. A work machine (1.1, 1.2, 1.3) comprising:

precisely one main vehicle axle (3), wheel elements (4.1, 4.2) arranged on both sides of the main vehicle axle (3), a working unit (2) or a holder (9) for a working unit, wherein said working unit or holder is arranged on a vehicle frame (12) by means of at least two pivot arms (6, 6.1, 6.2) with a rotatably mounted working arm (7, 7.1, 7.2), wherein at least one displaceable weight (5, 5.1, 5.2) is provided, wherein said displaceable weight is arranged on a vehicle frame (12) by means of at least one rod system (11, 11.1, 11.2), wherein an exclusive movement channel (16.1, 16.2, 16.3, 16.4, 16.5, 16.6, 16.7, 16.8, 16.9, 16.10) along the vehicle longitudinal axis (14) is assigned to each of the at least one displaceable weight (5, 5.1, 5.2), the rod system(s) (11, 11.1, 11.2) and the at least two pivot arms (6, 6.1, 6.2) with the rotatably mounted working arm (7, 7.1, 7.2), wherein the first movement channel (16.1) for the displaceable weight (5) takes up a central position on a vehicle transverse axis (15), wherein the at least two pivot arms (6.1, 6.2) and at least two working arms (7.1, 7.2) are arranged in such a way that in each case one of the at least two pivot arms (6.1, 6.2) and in each case one of the working arms (7.1, 7.2) lie in the same level and each take up only a fourth and/or fifth movement channel (16.4, 16.5), and wherein the wheel elements (4.1, 4.2) are located in the direction of the vehicle transverse axis (15) in the same area as the fourth and fifth movement channels (16.4, 16.5) for the at least two pivot arms (6.1, 6.2) and the two working arms (7.1, 7.2).

2. Work machine (1.1, 1.2, 1.3) according to claim 1, wherein at least the second and third movement channels (16.2, 16.3) for at least two of the rod systems (11.1, 11.2) are arranged laterally in the direction of the vehicle transverse axis (15) adjacent to the first movement channel (16.1).

3. Work machine (1.1, 1.2, 1.3) according to claim 1, wherein at least the fourth and the fifth movement channels (16.4, 16.5) for at least the two pivot arms (6.1, 6.2) and the two assigned working arms (7.1, 7.2) are arranged laterally in the direction of the vehicle transverse axis (15) adjacent to the second and third movement channels (16.2, 16.3).

4. Work machine (1.1, 1.2, 1.3) according to claim 1, wherein a sixth movement channel (16.6) for a first pivot arm of the at least two pivot arms (6) and the assigned first working arm (7) takes up a central position on a vehicle transverse axis (15).

5. Work machine (1.1, 1.2, 1.3) according to claim 4, wherein at least seventh and eighth movement channels (16.7, 16.8) for at least two rod systems (11.1, 11.2) are arranged laterally in the direction of the vehicle transverse axis (15) adjacent to the sixth movement channel (16.6) of the first pivot arm (6) and the first working arm (7).

6. Work machine (1.1, 1.2, 1.3) according to claim 5, wherein at least ninth and tenth movement channels (16.9, 16.10) for at least two displaceable weights (5.1, 5.2) are arranged laterally in the direction of the vehicle transverse axis (15) adjacent to the seventh and eighth movement channels (16.7, 16.8) of the rod systems (11.1, 11.2).

7. Work machine (1.1, 1.2, 1.3) according to claim 6, wherein the displaceable weights (5.1; 5.2) are fixedly connected to one another on the rear vehicle side.

8. A work machine (101) comprising:

a vehicle;

a further working unit (102) or a further holder (110) for a further working unit (102), precisely only one further main vehicle axle (103), further wheels (104) arranged on both sides of the only one further main vehicle axle (103), further drive units (109) assigned to the further wheels (104), at least one further auxiliary wheel (106), wherein the further auxiliary wheel (106) comprises at least one device for detecting a load, wherein a further displaceable weight (105) is provided, wherein a position of the further displaceable weight (105) is controlled in such a way that the load on the further auxiliary wheel (106) is within a lower and an upper limit value;

wherein at least one controller is provided and the at least one controller comprises a control loop which, when the load falls below the lower limit value, controls the drive units in such a way that the applied drive torque can be varied in such a way as to suitably prevent the vehicle from tipping over, wherein the upper and lower limit values are variable and adjust automatically depending on a speed of the vehicle, and wherein, at a certain speed, the further working unit automatically transitions into a self-balancing driving mode, in which the further working unit balances about the main axis and no load is applied to the further auxiliary wheel.

9. Work machine (101) according to claim 8, wherein the control system controls the further drive units (109) in such a way, when the further auxiliary wheel (106) is lifted off a ground, that the torque of the further drive units (109) is variable, suitable to prevent the work machine from tipping over, and wherein the further auxiliary wheel (106) can be returned to the ground.

10. Work machine (101) according to claim 8, wherein the control system controls the further drive units (109) when the load falls below the lower limit value in such a way that the torque of the further drive units (109) can be changed in such a way as to prevent the vehicle from tipping over, wherein the change in torque required for this purpose is only applied until the load on the further auxiliary wheel (106) is again above the lower limit value.

11. Work machine (101) according to claim 8, wherein, when the load on the further auxiliary wheel (106) falls below the lower limit value, the control system actuates the further drive units (109) in such a way as to suitably prevent the vehicle from tipping over and the position of the further displaceable weight (105) is changed until the load on the further auxiliary wheel (106) is again at least at the lower limit value.

12. Work machine (101) according to claim 8, wherein the control unit controls the further drive units (109) in such a way when the load falls below the lower limit value, wherein the vehicle changes into a driving mode of a self-balancing, when a signal is present to the control unit which gives an instruction after a change into the driving mode of the self-balancing.

13. Work machine (101) according to claim 12, wherein the further work machine (101) above a speed automatically switches to the driving mode of self-balancing, in which the further work machine (101) balances around the main vehicle axle and no load is applied to the further auxiliary wheel (106).

14. Work machine (101) according to claim 13, wherein the further auxiliary wheel (106) is arranged on the further displaceable weight (105).

15. Work machine (101) according to claim 8, wherein the control loop is an electronic control loop, and comprises at least inclination sensors and/or load sensors.

16. Work machine (101) according to claim 8, wherein the further drive units (109) are electric drives.

17. A work machine (201.1, 201.2, 2011.3) comprising:

a vehicle/vehicle frame a third working unit (202.1, 202.2, 202.3) or a third holder (224) for a working unit, one or more third vehicle axles (203), third wheel elements (204) arranged on both sides of the third vehicle axles (203), wherein a third displaceable weight (205) is provided, wherein a third rod system (206.1) is provided for fastening and guiding the displaceable third weight (205), wherein the third rod system (206.1) comprises at least three rods (207.1, 207.2, 207.3), wherein a first rod (207.1) is rotatably mounted on the vehicle/vehicle frame (215) via a first hinge point (208.1) and a second rod (207.2) is rotatably mounted on the vehicle/vehicle frame (215) via a second hinge point (208.2), and a third rod (207.3) is rotatably connected to the first rod (207.1) by a third hinge point (208.3) and is rotatably connected to the second rod (207.2) by a fourth hinge point (208.4), wherein the third displaceable weight (205) is rotatably or fixedly attached to the vehicle/vehicle frame (215) via a fifth hinge point (208.5) and is rotatably or fixedly attached to the third rod (207.3), wherein the first to fourth hinge points (208.1, 208.2, 208.3, 208.4) are arranged in such a way that they form a polygon (219) via their connecting lines (209.1, 209.2, 209.4, 209.5) with at least four sides, wherein the third hinge point (208.3), the fourth hinge point (208.4) and the fifth hinge point (208.5) of the third rod (207.3) are connected by a first connecting line (209.3) and a second connecting line (209.5) which are at a fixed angle (217.1) of more than 90° to each other, wherein the length of the connecting line (209.4) on the vehicle/vehicle frame (215), the length of the connecting line (209.1) of the first rod (207.1), the length of the connecting line (209.2) of the second rod (207.2), the fixed angle (217.1) of the third rod (207.3) and the length of the connecting line (209.3) and the connecting line (209.5) of the third rod (207.3) are arranged in such a way that the third rod (207.3) guides, via the fifth hinge point (208.5), the third displaceable weight (205) during displacement on a straight line (16) fixedly assigned with respect to the third work machine (201.1, 201.2, 201.3).

* * * * *